United States Patent [19]

Hirose et al.

[11] Patent Number: 4,584,266

[45] Date of Patent: Apr. 22, 1986

[54] COLOR PHOTOGRAPHIC LIGHT-SENSITIVE MATERIAL

[75] Inventors: Takeshi Hirose; Kotaro Nakamura; Nobuo Furutachi, all of Kanagawa, Japan

[73] Assignee: Fuji Photo Film Co., Ltd., Kanagawa, Japan

[21] Appl. No.: 696,609

[22] Filed: Jan. 30, 1985

[30] Foreign Application Priority Data

Jan. 31, 1984 [JP] Japan ..... 59-15503

[51] Int. Cl.[4] ..... G03C 7/38

[52] U.S. Cl. ..... 430/555; 430/505; 430/558

[58] Field of Search ..... 430/555, 558, 505

[56] References Cited

U.S. PATENT DOCUMENTS

| | | | |
|---|---|---|---|
| 4,264,723 | 4/1981 | Ichijima et al. | 430/555 |
| 4,351,897 | 9/1982 | Aoki et al. | 430/505 |
| 4,429,038 | 1/1984 | Moll et al. | 430/510 |
| 4,483,918 | 11/1984 | Sakai et al. | 430/555 |

OTHER PUBLICATIONS

Bulletin of the Society of Scientific Photography of Japan, No. 16, Dec. 1966.

*Primary Examiner*—J. Travis Brown

*Attorney, Agent, or Firm*—Sughrue, Mion, Zinn, Macpeak and Seas

[57] ABSTRACT

A silver halide color photographic light-sensitive material comprising a support having coated thereon at least one silver halide emulsion layer, the color photographic light-sensitive material having a photographic layer containing at least one 2-equivalent 5-pyrazolone type magenta coupler represented by the general formula (I) described below and an amount of a calcium atom contained in the color photographic light-sensitive material being up to 10 mg/m$^2$.

(I)

wherein W represents an aryl group; X represents an aliphatic group, an aryl group or a heterocyclic group; and Y represents an acylamino group, a ureido group or an anilino group.

The silver halide color photographic light-sensitive material containing the 2-equivalent 5-pyrazolone magenta coupler and the restricted amount of the calcium atom exhibits photographic properties which are not influenced by variations in the pH of the color developing bath and can provide color images fast to light and heat.

38 Claims, No Drawings

COLOR PHOTOGRAPHIC LIGHT-SENSITIVE MATERIAL

FIELD OF THE INVENTION

The present invention relates to a color photographic light-sensitive material, and more particularly, to a color photographic light-sensitive material wherein the dye forming efficiency in the color development step is high, photographic properties are not influenced by variations in the pH of the color development bath, and the color images are fast to heat and light.

BACKGROUND OF THE INVENTION

Various pyrazolone derivatives have been known as magenta color image forming couplers (referred to hereinafter simply as "magenta couplers"). However, these pyrazolone derivatives generally have low color forming efficiency (ratio of conversion of the coupler into a dye) when contained in photographic light-sensitive materials, and so-called 4-equivalent couplers, in which the coupling active position is not substituted, usually form only about ½ mol of dye per mol of the coupler.

To improve color forming efficiency, so-called 2-equivalent magenta couplers have been known, in which a substituent is introduced into the coupling active position of a pyrazolone type magenta coupler, and the substituent splits off in the color development step. Examples of such couplers are disclosed, for instance, in U.S. Pat. Nos. 3,311,476, 3,419,391, 3,617,291, 3,926,631, etc. Further, magenta couplers in which a substituent is connected to the coupling active position through a sulfur atom (hereinafter referred to as "thio-releasing type") are described in U.S. Pat. No. 3,214,437 (a thiocyano group), U.S. Pat. No. 4,032,346 (an acylthio group or a thioacylthio group), U.S. Pat. Nos. 3,227,554 and 3,701,783 and British Pat. No. 1,494,777 (an arylthio group or a heterocyclic thio group), and West German Patent Application (OLS) No. 2,944,601 (an alkylthio group).

It has been found that when couplers having an arylthio group at the coupling active position among the magenta couplers described in U.S. Pat. Nos. 3,227,554 and 3,701,783 are used in a color photographic light-sensitive material and color images are formed, the light fastness of the color images does not completely satisfy the color photographic light-sensitive materials.

Also, it has been found that when magenta couplers which release an arylthio group as described in British Pat. No. 1,494,777 are used in a color photographic light-sensitive material and color images are formed, the light fastness of the color images is insufficient.

Magenta couplers which release an arylthio group as described in U.S. Pat. No. 4,351,897 are distinguishable in view of overcoming these known defects described above.

However, the photographic light-sensitive materials containing these known magenta couplers in which the 4-position of a pyrazolone nucleus is substituted with a sulfur atom have a tendency to cause desensitization and/or a decrease in density of magenta color images upon color development processing. In particular, such a tendency becomes remarkably strong in the cases where a large amount of the photographic light-sensitive materials are continuously processed, for example, where a large amount of the photographic light-sensitive materials are commercially processed in color processing laboratories. This problem is a severe obstacle in practical use.

SUMMARY OF THE INVENTION

Therefore, an object of the present invention is to provide a color photographic light-sensitive material containing a thio-releasing type 2-equivalent 5-pyrazolone magenta coupler in which the degradation of photographic properties does not occur in conventional color processing, particularly even in continuous processing.

Another object of the present invention is to provide a color photographic light-sensitive material which forms color images having a good fastness.

Still another object of the present invention is to provide a color photographic light-sensitive material in which photographic properties are less influenced by variations in the pH of the color developing solution.

A further object of the present invention is to provide a low cost color photographic light-sensitive material having reduced coupler content and reduced silver halide content.

Other objects of the present invention will become apparent from the following detailed description and examples.

The above-described objects of the present invention can be attained by a silver halide color photographic light-sensitive material comprising a support having coated thereon at least one silver halide emulsion layer, the color photographic light-sensitive material having a photographic layer containing at least one 2-equivalent 5-pyrazolone type magenta coupler represented by the general formula (I) described below and an amount of a calcium atom contained in the color photographic light-sensitive material being up to 10 mg/m$^2$.

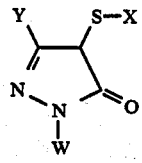

(I)

wherein W represents an aryl group; X represents an aliphatic group, an aryl group or a heterocyclic group; and Y represents an acylamino group, a ureido group or an anilino group.

DETAILED DESCRIPTION OF THE INVENTION

The magenta couplers which can be used in the present invention are described in more detail below.

In the general formula (I), W represents preferably a phenyl or naphthyl group substituted with at least one halogen atom, an alkyl group, an alkoxy group, an alkoxycarbonyl group and a cyano group.

The aliphatic group represented by X preferably has 1 to 42 carbon atoms. The aliphatic group is preferably a straight chain or branched chain alkyl group, an alkenyl group, a cycloalkyl group, an aralkyl group or an alkynyl group and these groups may be substituted with one or more substituents selected from a halogen atom, a hydroxy group, a mercapto group, a cyano group, a nitro group, a carboxy group, an aryl group, an alkoxy group, an aryloxy group, a heterocyclic oxy group, an acyloxy group, an alkoxycarbonyloxy group, an aryloxycarbonyloxy group, a silyloxy group, a carbamoyloxy group, a phosphoric acid oxy group, an acylamino group, a sulfonamido group, an alkoxycarbonylamino group, an aryloxycarbonylamino group, a diacylamino group, a carbamoylamino group, a sulfamoylamino group, an aromatic heterocyclic group such as a pyrazolyl group, an imidazolyl group, a triazolyl group, etc., a non-aromatic heterocyclic group such as a piperidino group, a morpholino group, etc., an imido group, a monooxo nitrogen containing heterocyclic group such as a pyridone group, a saccharin group, etc., an acyl group, an alkoxycarbonyl group, an aryloxycarbonyl group, a carbamoyl group, a sulfamoyl group, a silyl group, an alkylthio group, an arylthio group, a heterocyclic thio group, a sulfonyl group, a sulfinyl group, an anilino group, and the like.

The aryl group represented by X preferably has from 6 to 46 carbon atoms and is preferably a phenyl group or a naphthyl group and these groups may be substituted with one or more substituents selected from an alkyl group and the above-described substituents for the aliphatic group.

The heterocyclic group represented by X is preferably a 5-membered or 6-membered heterocyclic group containing at least one of a nitrogen atom, an oxygen atom and a sulfur atom and these heterocyclic groups may be condensed with a benzene ring. Typical heterocyclic skeletons are illustrated below.

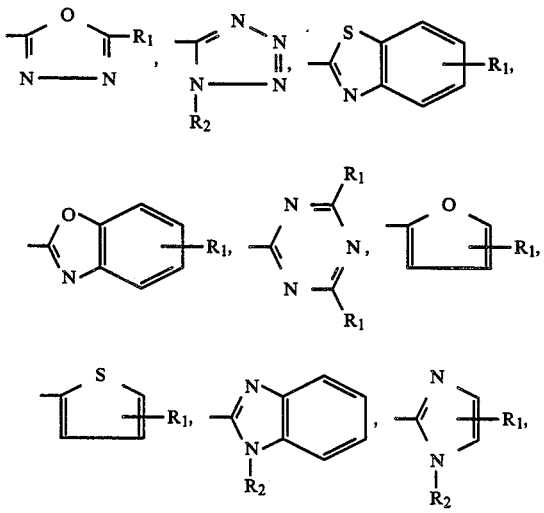

-continued

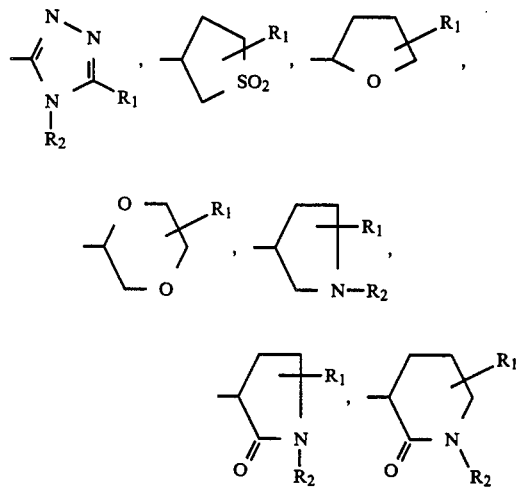

wherein $R_1$ represents a hydrogen atom, an alkyl group or a substituent selected from the above-described substituents for the aliphatic group; and $R_2$ represents a hydrogen atom, an alkyl group, an aryl group, an acyl group, an alkylsulfonyl group or an arylsulfonyl group.

The acylamino group represented by Y is preferably an alkanamido group or a benzamido group. The ureido group represented by Y is preferably an alkylureido group or a phenylureido group. The anilino group represented by Y is preferably a phenylamino group. The alkyl moiety included in the above-described groups for Y has from 1 to 42 carbon atoms, and the phenyl moiety included in the above-described groups for Y has from 6 to 46 carbon atoms.

The alkyl moiety included in the above-described groups for Y may be substituted with a substituent selected from the above-described substituents for the aliphatic group represented by X, and the phenyl moiety included in the above-described groups for Y may be substituted with an alkyl group or a substituent selected from the above-described substituents for the aliphatic group represented by X.

Of the 2-equivalent 5-pyrazolone type magenta couplers represented by the general formula (I), particularly preferred couplers are represented by the following general formula (II) or (III):

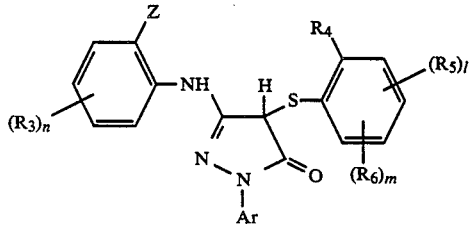

(II)

-continued

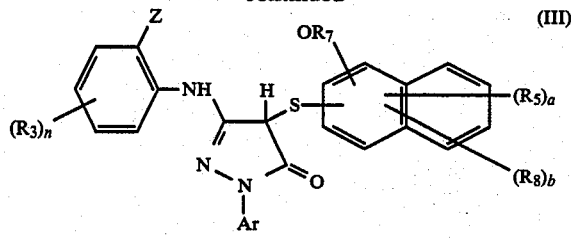

(III)

wherein Ar represents a phenyl group substituted with at least one of a halogen atom, an alkyl group, an alkoxy group, an alkoxycarbonyl group or a cyano group; Z represents a halogen atom or an alkoxy group; $R_3$ represents a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, a ureido group, an acyl group, a nitro group or a carboxy group; $R_4$ represents a halogen atom, a hydroxy group, an amino group, an aliphatic group, an alkoxy group, an aryloxy group or an aryl group; $R_5$ represents a hydrogen atom, an amino group, an acylamino group, a ureido group, an alkoxycarbonylamino group, an imido group, a sulfonamido group, a sulfamoylamino group, a nitro group, an alkoxycarbonyl group, a carbamoyl group, an acyl group, a cyano group or an alkylthio group; $R_6$ represents a hydrogen atom, a halogen atom, a hydroxy group, an aliphatic group, an alkoxy group or an aryl group; at least one of $R_4$ and $R_6$ represents an alkoxy group; n represents an integer of from 1 to 4; m represents an integer of from 1 to 3; l represents an integer of from 1 to 3; $R_7$ represents an aliphatic group or an aryl group; $R_8$ represents a hydrogen atom, a halogen atom, an aliphatic group, an alkoxy group, an aryloxy group or an aryl group; a represents an integer of from 1 to 5; and b represents an integer of from 1 to 5.

The magenta couplers represented by the general formulae (II) and (III) are described in more detail below.

In the general formula (II) or (III), Ar represents a substituted phenyl group. The substituent for the phenyl group includes a halogen atom (for example, a chlorine atom, a bromine atom, a fluorine atom, etc.), an alkyl group having from 1 to 22 carbon atoms (for example, a methyl group, an ethyl group, a tetradecyl group, a tert-butyl group, etc.), an alkoxy group having from 1 to 22 carbon atoms (for example, a methoxy group, an ethoxy group, an octyloxy group, a dodecyloxy group, etc.), an alkoxycarbonyl group having from 2 to 23 carbon atoms (for example, a methoxycarbonyl group, an ethoxycarbonyl group, a tetradecyloxycarbonyl group, etc.), or a cyano group.

Z in the general formula (II) or (III) represents a halogen atom (for example, a chlorine atom, a bromine atom, a fluorine atom, etc.) or an alkoxy group having from 1 to 22 carbon atoms (for example, a methoxy group, an octyloxy group, a dodecyloxy group, etc.).

$R_3$ in the general formula (II) or (III) represents a hydrogen atom, a halogen atom (for example, a chlorine atom, a bromine atom, a fluorine atom, etc.), an alkyl group (for example, a methyl group, a tert-butyl group, a 2-methanesulfonamidoethyl group, a tert-butanesulfonylethyl group, a tetradecyl group, etc.), an alkoxy group (for example, a methoxy group, an ethoxy group, a 2-ethylhexyloxy group, a tetradecyloxy group, etc.), an acylamino group (for example, an acetamido group, a benzamido group, a butanamido group, a tetradecanamido group, an α-(2,4-di-tert-amylphenoxy)acetamido group, an α-(2,4-di-tert-amylphenoxy)butyramido group, an α-(3-pentadecylphenoxy)hexanamido group, an α-(4-hydroxy-3-tert-butylphenoxy)tetradecanamido group, a 2-oxopyrrolidin-1-yl group, a 2-oxo-5-tetradecylpyrrolidin-1-yl group, an α-(3-methanesulfonamidophenoxy)tetradecanamido group, an N-methyltetradecanamido group, etc.), a sulfonamido group (for example, a methanesulfonamido group, a benzenesulfonamido group, a p-toluenesulfonamido group, an octanesulfonamido group, a p-dodecylbenzenesulfonamido group, an N-methyltetradecanesulfonamido group, etc.), a sulfamoyl group (for example, an N-methylsulfamoyl group, an N-hexadecylsulfamoyl group, an N-[3-(dodecyloxy)propyl]sulfamoyl group, an N-[4-(2,4-di-tert-amylphenoxy)butyl]sulfamoyl group, an N-methyl-N-tetradecylsulfamoyl group, etc.), a carbamoyl group (for example, an N-methylcarbamoyl group, an N-octadecylcarbamoyl group, an N-[4-(2,4-di-tert-amylphenoxy)butyl]carbamoyl group, an N-methyl-N-tetradecylcarbamoyl group, etc.), a diacylamino group (for example, an N-succinimido group, an N-phthalimido group, a 2,5-dioxo-1-oxazolidinyl group, a 3-dodecyl-2,5-dioxo-1-hydantoinyl group, a 3-(N-acetyl-N-dodecylamino)succinimido group, etc.), an alkoxycarbonyl group (for example, a methoxycarbonyl group, a tetradecyloxycarbonyl group, a benzyloxycarbonyl group, etc.), an alkoxysulfonyl group (for example, a methoxysulfonyl group, an octyloxysulfonyl group, a tetradecyloxysulfonyl group, etc.), an aryloxysulfonyl group (for example, a phenoxysulfonyl group, a 2,4-di-tert-amylphenoxysulfonyl group, etc.), an alkanesulfonyl group (for example, a methanesulfonyl group, an octanesulfonyl group, a 2-ethylhexanesulfonyl group, a hexadecanesulfonyl group, etc.), an arylsulfonyl group (for example, a benzenesulfonyl group, a 4-nonylbenzenesulfonyl group, etc.), an alkylthio group (for example, an ethylthio group, a hexylthio group, a benzylthio group, a tetradecylthio group, a 2-(2,4-di-tert-amylphenoxy)ethylthio group, etc.), an arylthio group (for example, a phenylthio group, a p-tolylthio group, etc.), an alkyloxycarbonylamino group (for example, an ethyloxycarbonylamino group, a benzyloxycarbonylamino group, a hexadecyloxycarbonylamino group, etc.), a ureido group (for example, an N-methylureido group, an N-phenylureido group, an N,N-dimethylureido group, an N-methyl-N-dodecylureido group, an N-hexadecylureido group, an N,N-dioctadecylureido group, etc.), an acyl group (for example, an acetyl group, a benzoyl group, an octadecanoyl group, a p-dodecanamidobenzoyl group, etc.), a nitro group, or a carboxy group. In the above-described substituents, the alkyl moieties thereof preferably have from 1 to 42 carbon atoms, and the aryl moieties thereof preferably have from 6 to 46 carbon atoms.

$R_4$ in the general formula (II) represents a halogen atom (for example, a chlorine atom, a bromine atom, etc.), a hydroxy group, an amino group (an unsubstituted or substituted amino group including an N-alkylamino group, an N,N-dialkylamino group, an N-anilino group, an N-alkyl-N-arylamino group, a heterocyclic amino group, etc., for example, an N-butylamino group, an N,N-dibutylamino group, an N,N-dihexylamino group, an N-piperidino group, an N,N-bis(2-dodecyloxyethyl)amino group, an N-cyclohexylamino group, an N-phenylamino group, an N,N-bis(2-hexanesulfonylethyl)amino group, etc.), an aliphatic group (including a straight chain or branched chain alkyl group, an aralkyl group, an alkenyl group, a cycloalkyl group, a cycloalkenyl group, for example, a methyl group, a butyl group, an octyl group, a dodecyloxy group, a benzyl group, a cyclopentyl group, a 2-methanesulfonylethyl group, a 3-phenoxypropyl group, etc.), an alkoxy group (for example, a methoxy group, a butoxy group, a benzyloxy group, a 2-ethylhexyloxy group, a dodecyloxy group, a 2-methanesulfonylethyloxy group, a 2-butanesulfonylethyloxy group, an isopropyloxy group, a 2-chloroethyloxy group, a 3-(2,4-di-tert-amylphenoxy)-propyloxy group, a 2-(N-methylcarbamoyl)ethoxy group, a cyclopentyloxy group, a 2-ethoxytetradecyloxy group, a 4,4,4,3,3,2,2-heptafluorobutyloxy group, a 3-(N-butyl-carbamoyl)-propyloxy group, a 3-(N,N-dimethylcarbamoyl)-propyloxy group, a 4-methanesulfonylbutoxy group, a 2-ethanesulfonamidoethyloxy group, etc.), an aryloxy group (for example, a phenoxy group, a 2,4-dichlorophenoxy group, etc.) or an aryl group (including an unsubstituted or substituted phenyl group having from 6 to 38 carbon atoms, an $\alpha$- or $\beta$-naphthyl group, for example, a phenyl group, an $\alpha$-naphthyl group, a $\beta$-naphthyl group, a 4-chlorophenyl group, a 4-tert-butylphenyl group, a methanesulfonamidophenyl group, a 2,4-dimethylphenyl group, etc.).

$R_5$ in the general formulae (II) and (III) represents a hydrogen atom, an amino group (an unsubstituted or substituted amino group including an N-alkylamino group, an N,N-dialkylamino group, an N-anilino group, an N-alkyl-N-arylamino group, a heterocyclic amino group, for example, an N-butylamino group, an N,N-diethylamino group, an N-[2-(2,4-di-tert-amylphenoxy)-ethyl]amino group, an N,N-dibutylamino group, an N-piperidino group, an N,N-bis(2-dodecyloxyethyl-)amino group, an N-cyclohexylamino group, an N,N-dihexylamino group, an N-phenylamino group, a 2,4-di-tert-amylphenylamino group, an N-(2-chloro-5-tetradecanamidophenyl)amino group, an N-methyl-N-phenylamino group, an N-(2-pyridyl)amino group, etc.), an acylamino group (for example, an acetamido group, a benzamido group, a tetradecanamido group, a (2,4-di-tert-amylphenoxy)acetamido group, a 2-chlorobenzamido group, a 3-pentadecylbenzamido group, a 2-(2-methanesulfonamidophenoxy)-dodecanamido group, a 2-(2-chlorophenoxy)tetradecanamido group, etc.), a ureido group (for example, a methylureido group, a phenylureido group, a 4-cyanophenylureido group, etc.), an alkoxycarbonylamino group (for example, a methoxycarbonylamino group, a dodecyloxycarbonylamino group, a 2-ethylhexyloxycarbonylamino group, etc.), an imido group (for example, an N-succinimido group, an N-phthalimido group, an N-hydantoinyl group, a 5,5-dimethyl-2,4-dioxooxazol-3-yl group, an N-(3-octadecenyl)succinimido group, etc.), a sulfonamido group (for example, a methanesulfonamido group, an octanesulfonamido group, a benzenesulfonamido group, a 4-chlorobenzenesulfonamido group, a 4-dodecylbenzenesulfonamido group, an N-methyl-N-benzenesulfonamido group, a 4-dodecyloxybenzenesulfonamido group, a hexadecanesulfonamido group, etc.), a sulfamoylamino group (for example, an N-octylsulfamoylamino group, an N,N-dipropylsulfamoylamino group, an N-ethyl-N-phenylsulfamoylamino group, an N-(4-butyloxy)sulfamoylamino group, etc.), a nitro group, an alkoxycarbonyl group (for example, a methoxycarbonyl group, a butoxycarbonyl group, a dodecyloxycarbonyl group, a benzyloxycarbonyl group, etc.), a carbamoyl group (for example, an N-octylcarbamoyl group, an N,N-dibutylcarbamoyl group, an N-phenylcarbamoyl group, an N-[3-(2,4-di-tert-amylphenoxy)propyl]carbamoyl group, etc.), an acyl group (for example, an acetyl group, a benzoyl group, a hexanoyl group, a 2-ethylhexanoyl group, a 2-chlorobenzoyl group, etc.), a cyano group, or an alkylthio group (for example, a dodecylthio group, a 2-ethylhexylthio group, a benzylthio group, a 2-oxocyclohexylthio group, a 2-(ethyltetradecanoate)thio group, a 2-(dodecylhexanoate)thio group, a 3-phenoxypropylthio group, a 2-dodecanesulfonylethylthio group, etc.).

$R_6$ in the general formula (II) represents a hydrogen atom, a hydroxy group, or a halogen atom, an aliphatic group, an alkoxy group, or an aryl group, each as defined for $R_4$ above. At least one of $R_4$ and $R_6$ represents an alkoxy group.

In the general formula (III), $R_7$ represents an aliphatic group or an aryl group, each as defined for $R_4$ above, and $R_8$ represents a hydrogen atom, or a halogen atom, an aliphatic group, an alkoxy group, an aryloxy group or an aryl group, each as defined for $R_4$ above.

An amount of the 2-equivalent 5-pyrazolone type magenta coupler used according to the present invention is preferably from $10^{-3}$ mol to 0.5 mol, particularly 0.01 mol or more, per mol of silver in a silver halide emulsion layer.

The calcium atom in the present invention includes whole calcium atoms present in the photographic light-sensitive material in various forms such as atom, molecule, ion, salt or complex salt. The effects of the present invention are clearly exhibited when the total amount of calcium atom in the photographic light-sensitive material is 10 mg/m$^2$ or less.

In order to determine the total amount of calcium atom included in the photographic light-sensitive material it is advantageous to utilize an ICP (Inductively Coupled Plasma) emission spectroanalysis. This analytical method is described in detail in *Kagaku no Ryoiki*, Extra Edition, No. 127, published by Nankodo (1980) or V. A. Fassel, *Anal. Chem.*, Vol. 46, page 1110A, Title: "Inductively Coupled Plasma Emission Spectroscopy" (1974).

In gelatin, which is used as a binder in silver halide color photographic light-sensitive materials, a considerable amount of calcium salts which originate in bones as starting materials are generally present. The amount of such calcium salts is usually several hundred ppm or more calculated as calcium atom. The amount of calcium salt is shown by an amount calculated as calcium atom hereinafter in the specification unless otherwise indicated. As a result, about 10 mg/m$^2$ or more of calcium is usually included in color photographic materials practically used. It is therefore an unexpected and surprising fact to one skilled in the art that the degradation of photographic properties, which occurs when the photographic light-sensitive material containing the coupler represented by the general formula (I) is processed, is prevented by decreasing the amount of calcium salt in the photographic light-sensitive material.

This phenomenon found by the inventors is extremely difficult to predict but it is thought that the desensitization or the decrease in density is caused by the specific interaction between calcium atoms and the coupler represented by the general formula (I). It is also believed that calcium atoms in photographic light-sensitive materials are dissolved in the form of ions and accumulate in the color developing solution when a large amount of photographic light-sensitive materials are continuously processed. Consequently, the above-described degradation of photographic properties becomes more notable. Further, the degradation of photographic properties is promoted where the color developing solution is prepared using water containing a large amount of calcium salt, that is, hard water.

As a result of various investigations, it has been found that the amount of calcium atom included in the photographic light-sensitive material must be 10 mg/m$^2$ or less in order to prevent the degradation of photographic properties. Also, it is preferred to be 5 mg/m$^2$ or less when considered for continuous processing. Further, it is more preferred to be 2 mg/m$^2$ or less where the processing is carried out continuously with a color developing solution prepared using hard water as the base water.

In order to achieve the embodiments according to the present invention, various methods can be employed. Examples of such methods are described below.

1. Use gelatin having a low calcium content as a starting material for the production of the photographic light-sensitive material.

2. Carry out prior desalting of the additives containing gelatin such as the gelatin solution, emulsified dispersions, silver halide emulsions, etc., for the production of the photographic light-sensitive material by a noodle washing method or by dialysis, etc.

Of the above-described methods, Method 1 is preferred in view of the production stability of the photographic light-sensitive material. The calcium content in gelatin is different depending on the process of its preparation, but usually the content is 2,000 ppm or more in lime-processed gelatin and 1,000 ppm or more in acid-processed gelatin. By the treatment of such a gelatin with an $Na^+$ type or $H^+$ type ion exchange resin, gelatin having a low calcium content (i.e., 100 ppm or less), that is, so-called demineralized gelatin can be obtained. Further, other treatment such as dialysis may be employed. In the present invention, any gelatin having a low calcium content can be advantageously employed irrespective of its method of preparation.

In the production of photographic light-sensitive materials, gelatin is usually added in the form of a silver halide (including a colloidal silver) emulsion, an emulsion containing a coupler, etc., or a gelatin solution merely as a binder. Therefore, by using gelatin having a low calcium content in all or a part of these additives, the photographic light-sensitive materials according to the present invention can be prepared. In the case of a multilayer color photographic light-sensitive material, it is not necessary to limit the use of gelatin of a low calcium content only to a layer containing the coupler represented by the general formula (I). Such a gelatin can be used in other layers, for example, other emulsion layers, an intermediate layer, a protective layer, etc., whereby the content of calcium atoms is reduced as a whole to obtain similar results. It is desirable to remove or reduce the amount of the calcium salts from as many layers as possible in order to achieve the desired low content of calcium in the photographic material.

Specific examples of the magenta couplers represented by the general formula (I) used in the present invention are set forth below, but the present invention is not to be construed as being limited to these compounds.

(1)
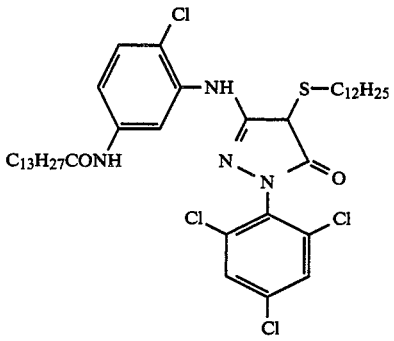
(2)
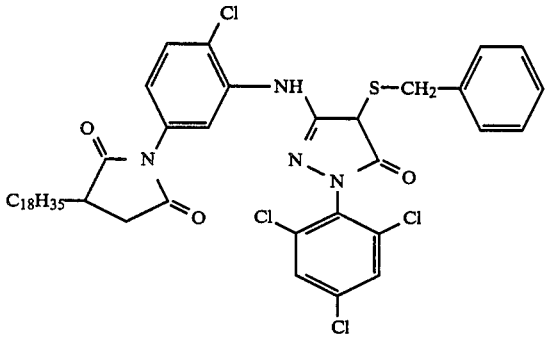
(3)
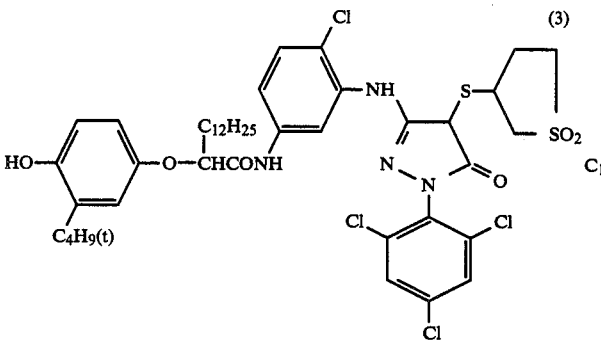
(4)
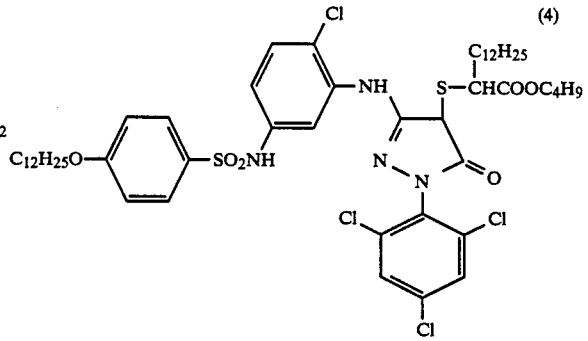
(5)
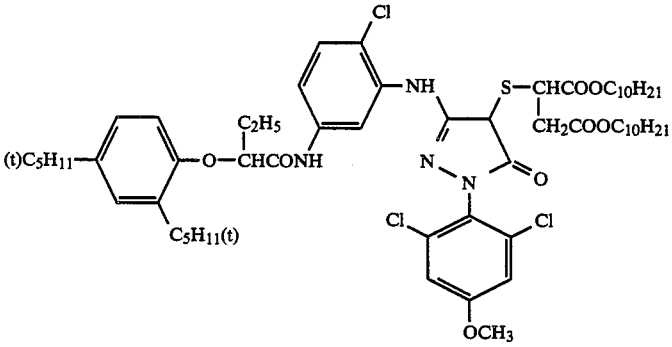
(6)
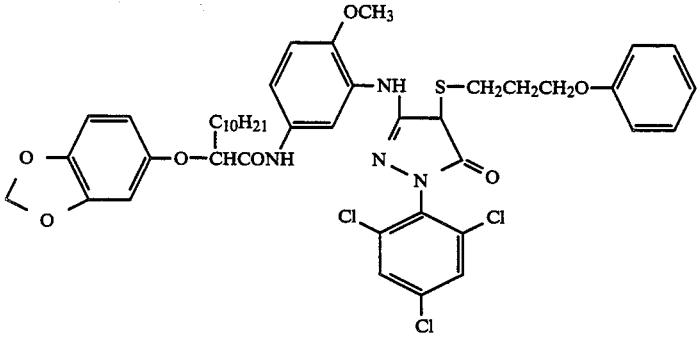
(7)
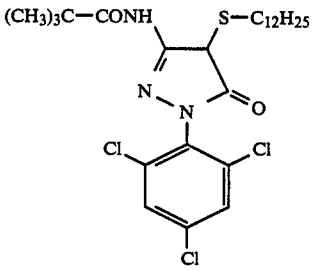
(8)
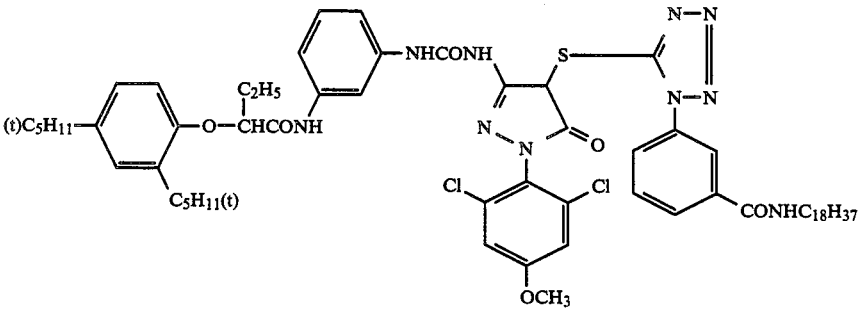

-continued
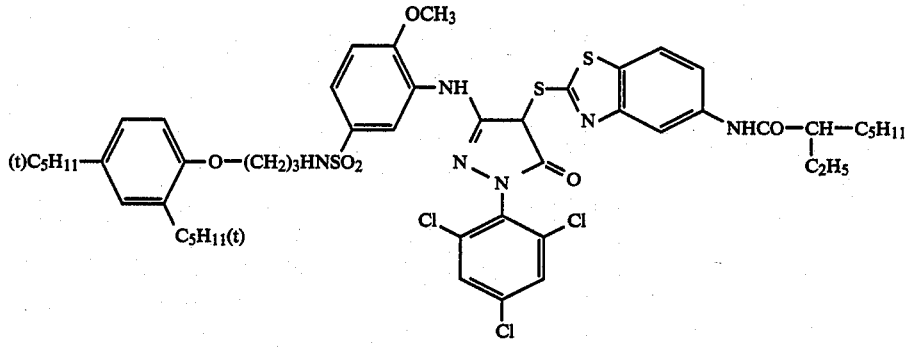
(9)
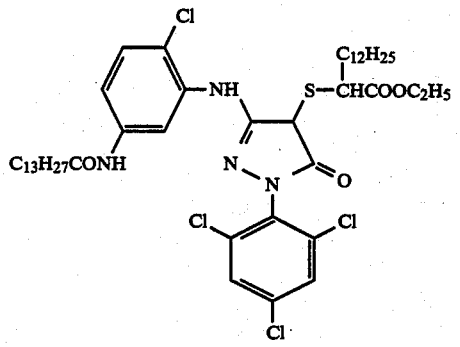
(10)
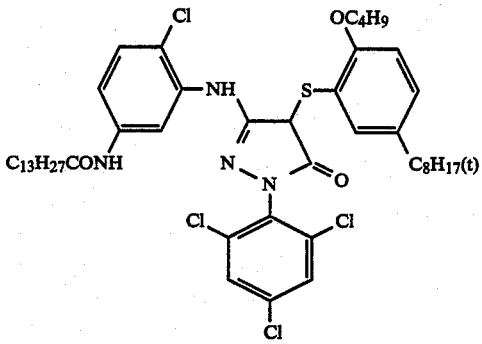
(11)
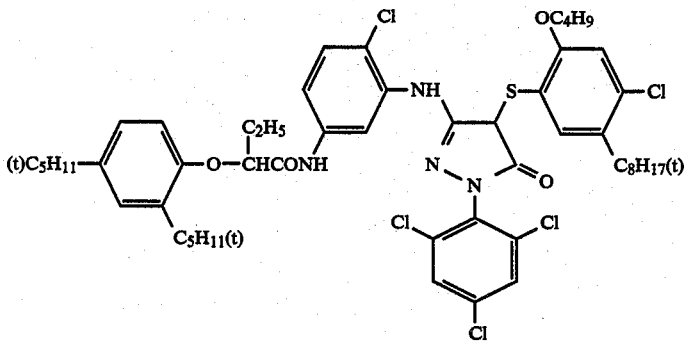
(12)
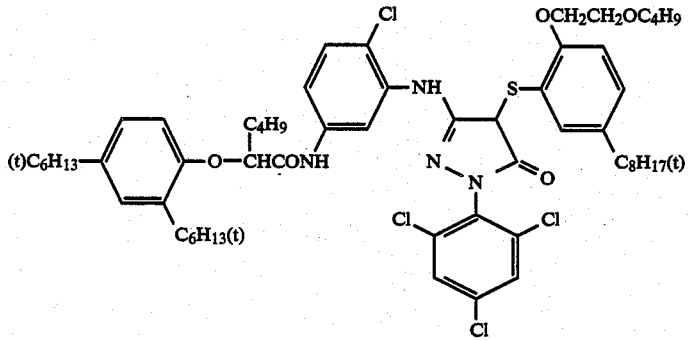
(13)

-continued
(14)
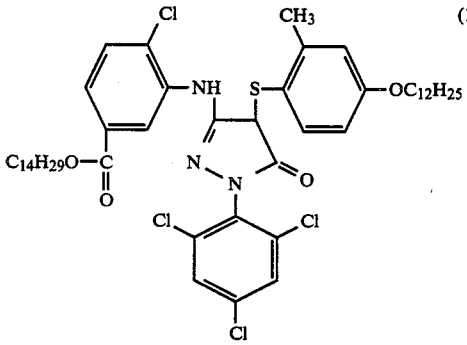
(15)
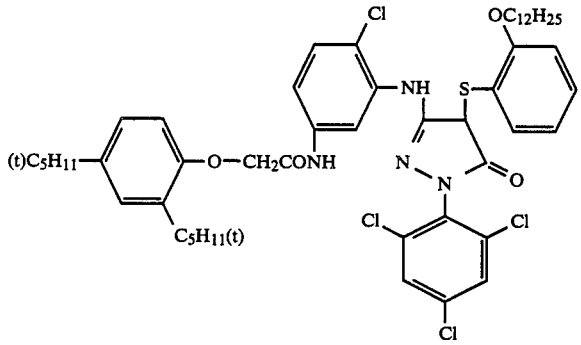
(16)
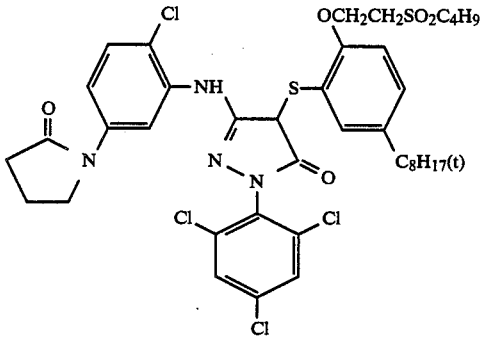
(17)
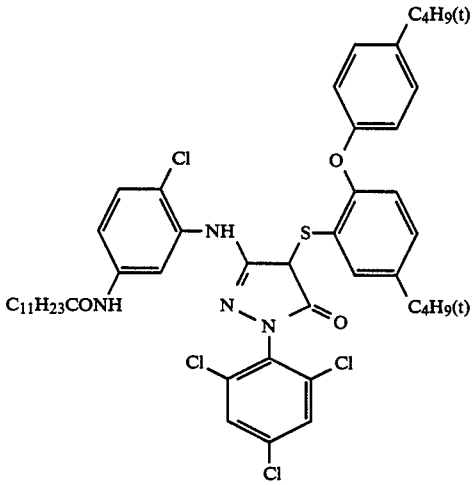
(18)
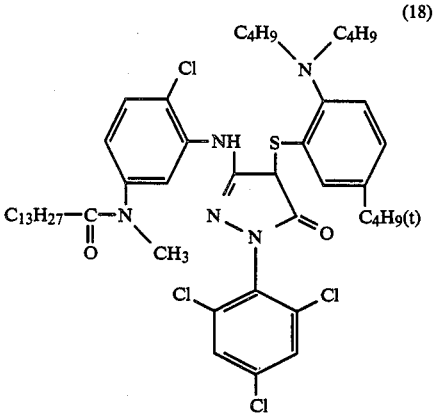
(19)
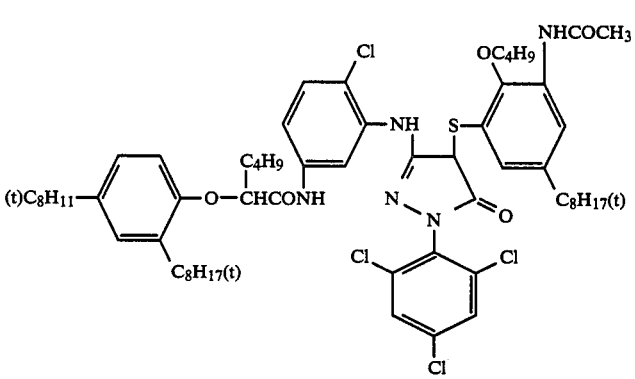
(20)
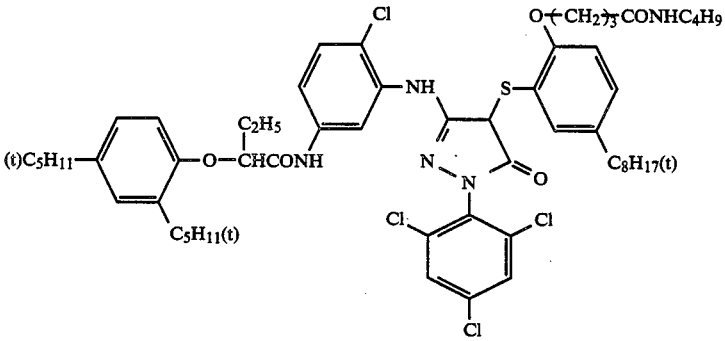

-continued
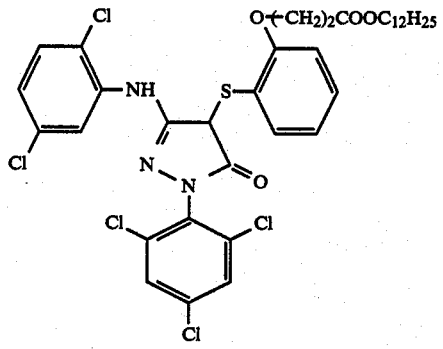
(21)
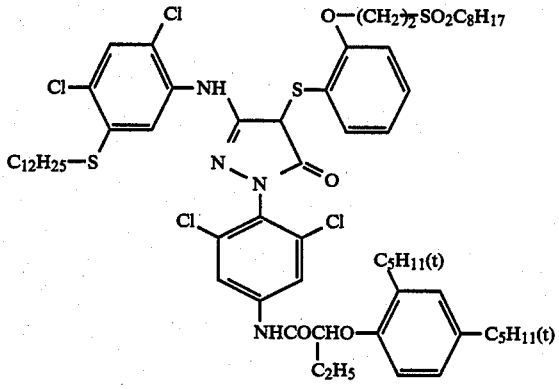
(22)
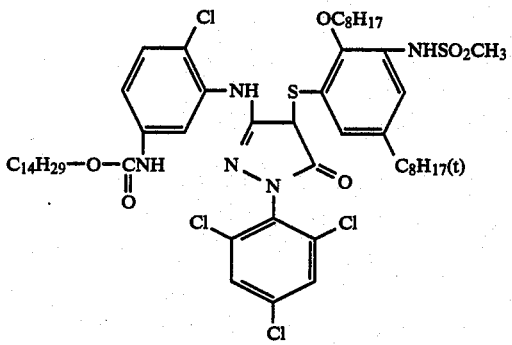
(23)
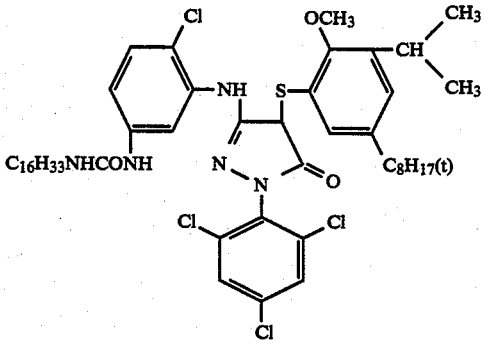
(24)
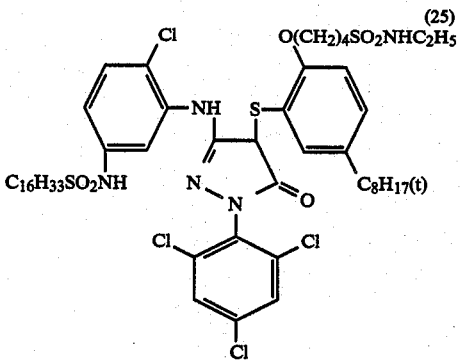
(25)
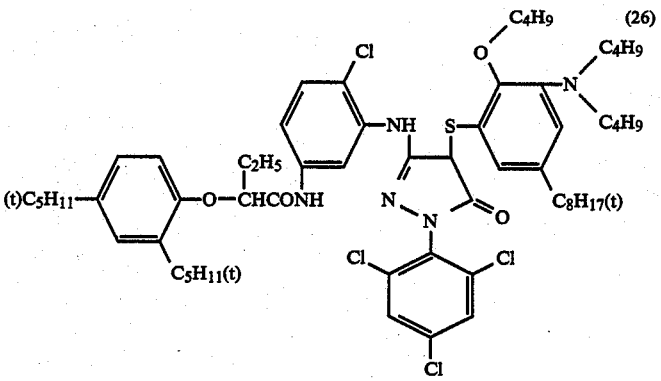
(26)
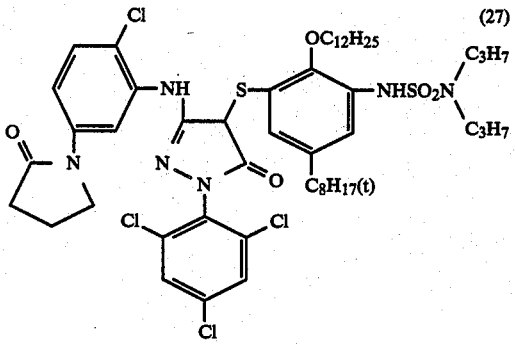
(27)
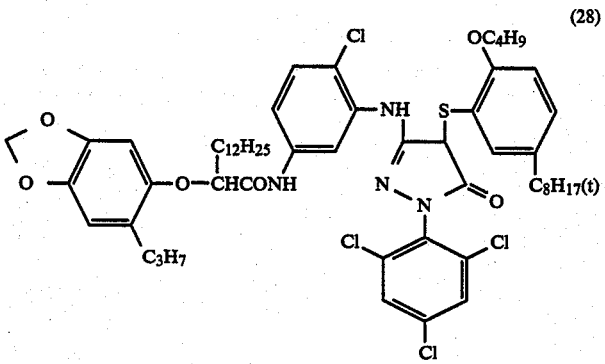
(28)

-continued
(29)
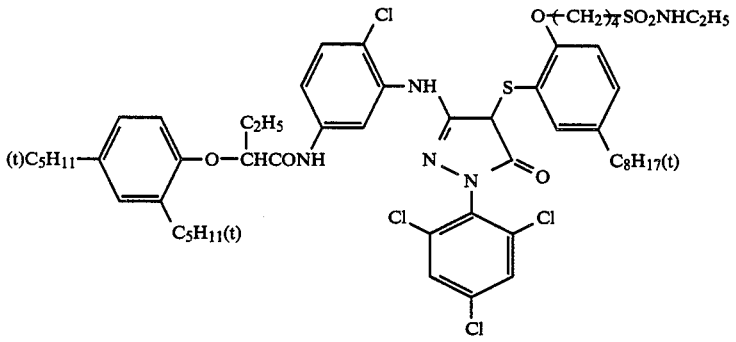
(30)
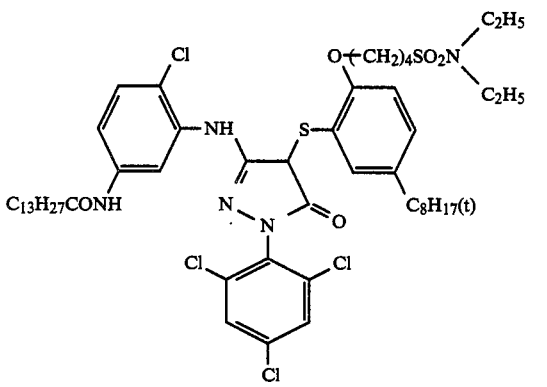
(31)
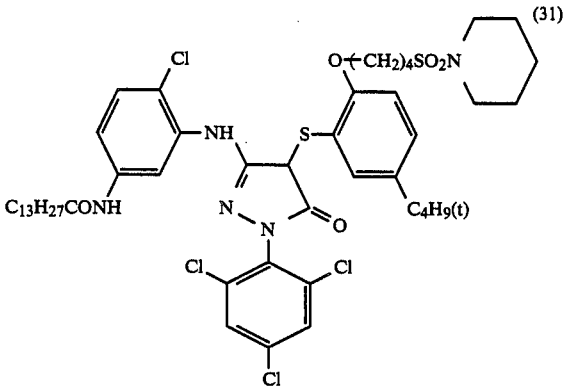
(32)
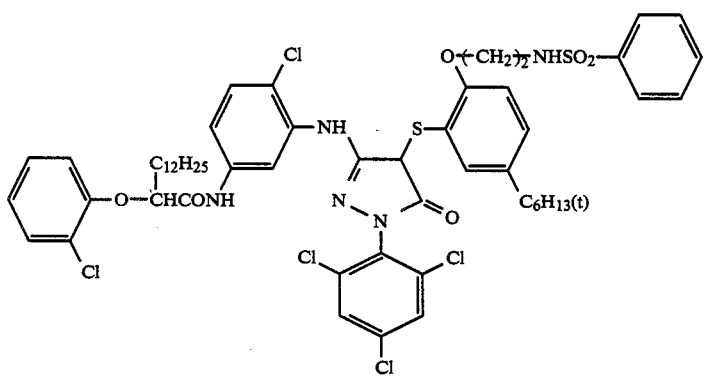
(33)
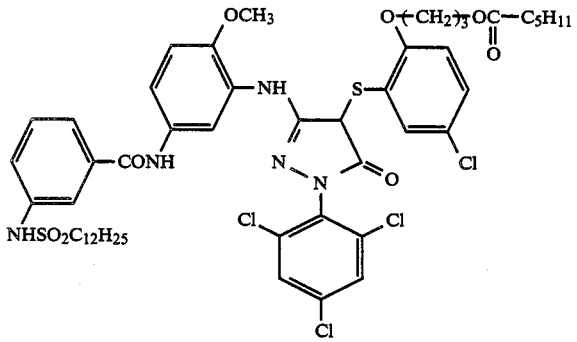

-continued (34)

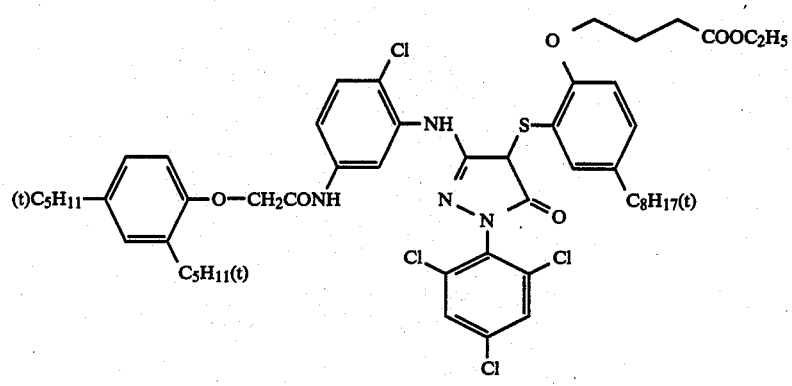

(35)

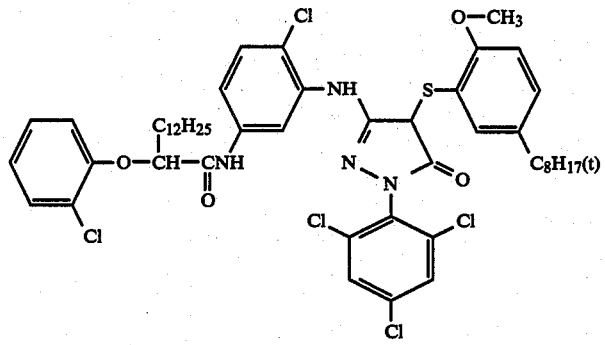

(36)

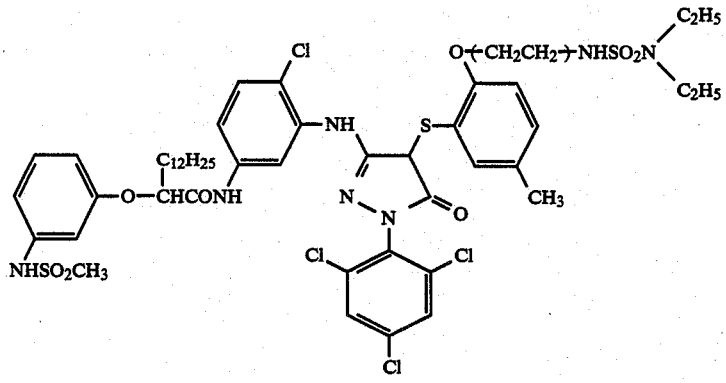

(37)

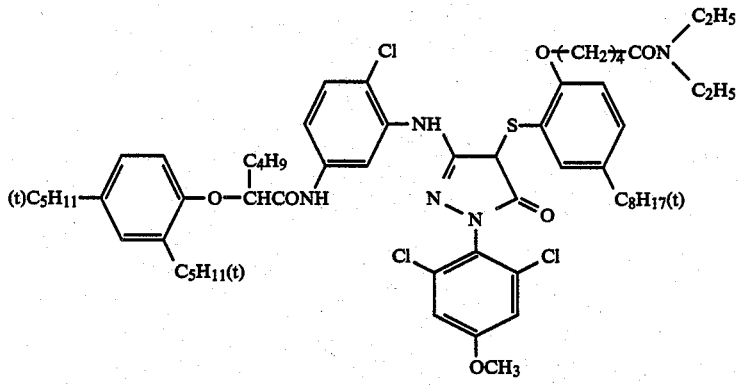

The magenta couplers represented by the general formula (I) used in the present invention can be prepared by the methods as described in, for example, U.S. Pat. Nos. 3,227,554 and 3,701,783, Japanese Patent Publication No. 34044/78, West German Patent Application (OLS) No. 2,944,601 and U.S. Pat. No. 4,351,897.

In order to incorporate the coupler according to the present invention into a silver halide emulsion layer, known methods, including those described, e.g., in U.S. Pat. No. 2,322,027, can be used. For example, the coupler can be dissolved in a solvent and then dispersed in a hydrophilic colloid. Examples of solvents usable for this process include organic solvents having a high boiling point, such as alkyl esters of phthalic acid (e.g., dibutyl phthalate, dioctyl phthalate, etc.), phosphates (e.g., diphenyl phosphate, triphenyl phosphate, tricresyl phosphate, dioctyl butyl phosphate, etc.), citrates (e.g., tributyl acetyl citrate, etc.), benzoates (e.g., octyl benzoate, etc.), alkylamides (e.g., diethyl laurylamides, etc.), esters of fatty acids (e.g., dibutoxyethyl succinate, diethyl azelate, etc.), trimesates (e.g., tributyl trimesate, etc.), or the like; and organic solvents having a boiling point of from about 30° to about 150° C., such as lower alkyl acetates (e.g., ethyl acetate, butyl acetate, etc.), ethyl propionate, secondary butyl alcohol, methyl isobutyl ketone, β-ethoxyethyl acetate, methyl cellosolve acetate, or the like. Mixtures of organic solvents having a high boiling point and organic solvents having a low boiling point can also be used.

It is also possible to utilize the dispersing method using polymers, as described in Japanese Patent Publication No. 39853/76 and Japanese Patent Application (OPI) No. 59943/76.

Of the couplers, those having an acid group, such as a carboxylic acid group or a sulfonic acid group, can be introduced into hydrophilic colloids as an aqueous alkaline solution.

As gelatin in the present invention, not only lime-processed gelatin, but also acid-processed gelatin may be employed. The methods for preparation of gelatin are described in greater detail in Ather Veis, *The Macromolecular Chemistry of Gelatin,* Academic Press (1964).

As the binder or the protective colloid for the photographic emulsion layers or intermediate layers of the photographic light-sensitive material of the present invention, demineralized gelatin is advantageously used as described above, but other hydrophilic colloids can be used alone or together with gelatin.

For example, it is possible to use proteins such as gelatin derivatives, graft polymers of gelatin and other polymers, albumin, casein, etc.; saccharides such as cellulose derivatives such as hydroxyethyl cellulose, carboxymethyl cellulose, cellulose sulfate, etc., sodium alginate, starch derivatives, etc.; and various synthetic hydrophilic high molecular weight substances such as homopolymers or copolymers, for example, polyvinyl alcohol, polyvinyl alcohol semiacetal, poly-N-vinylpyrrolidone, polyacrylic acid, polymethacrylic acid, polyacrylamide, polyvinyl imidazole, polyvinyl pyrazole, etc.

In the photographic emulsion layer of the photographic light-sensitive material used in the present invention, any of silver bromide, silver iodobromide, silver iodochlorobromide, silver chlorobromide and silver chloride may be used as the silver halide. A preferred silver halide is silver iodobromide containing 15 mol% or less of silver iodide. A silver iodobromide emulsion containing from 2 mol% to 12 mol% of silver iodide is particularly preferred.

Although the mean grain size of silver halide particles in the photographic emulsion (the mean grain size being determined from the grain diameter in those particles which are spherical or nearly spherical, and from the edge length in those particles which are cubic as a grain size, and is expressed as a mean value calculated from projected areas) is not particularly limited, it is preferably 3 μm or less.

The distribution of grain size may be broad or narrow.

Silver halide particles in the photographic emulsion may have a regular crystal structure, e.g., a cubic or octahedral structure, an irregular crystal structure, e.g., a spherical or tabular structure, or a composite structure thereof. In addition, silver halide particles composed of those having different crystal structures may be used.

Further, the photographic emulsion wherein at least 50% of the total projected area of silver halide particles is super tabular silver halide particles having a diameter at least five times their thickness may be employed.

The inner portion and the surface layer of silver halide particles may be different in phase. Silver halide particles may be those in which a latent image is formed mainly on the surface thereof, or those in which a latent image is formed mainly in the interior thereof.

The photographic emulsion used in the present invention can be prepared in any suitable manner, e.g., by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, an ammonia process, etc., can be employed.

Soluble silver salts and soluble halogen salts can be reacted by techniques such as a single jet process, a double jet process, and a combination thereof. In addition, there can be employed a method (a so-called reversal mixing process) in which silver halide particles are formed in the presence of an excess of silver ions.

As one system of the double jet process, a so-called controlled double jet process in which the pAg in a liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

The formation or physical ripening of silver halide particles may be carried out in the presence of cadmium salts, zinc salts, lead salts, thallium salts, iridium salts or its complex salts, rhodium salts or its complex salts, iron salts or its complex salts, and the like.

For removal of soluble salts from the emulsion after precipitate formation or physical ripening, a well known noodle washing process in which gelatin is gelated may be used. In addition, a flocculation process utilizing inorganic salts having a polyvalent anion (e.g., sodium sulfate), anionic surface active agents, anionic polymers (e.g., polystyrenesulfonic acid), or gelatin derivatives (e.g., aliphatic acylated gelatin, aromatic acylated gelatin and aromatic carbamoylated gelatin) may be used.

Silver halide emulsions are usually chemically sensitized. For this chemical sensitization, for example, the methods as described in H. Frieser ed., *Die Grundlagen*

*der Photographischen Prozesse mit Silberhalogeniden,* Akademische Verlagsgesellschaft, pages 675 to 734 (1968) can be used. Namely, a sulfur sensitization process using active gelatin or compounds (e.g., thiosulfates, thioureas, mercapto compounds and rhodanines) containing sulfur capable of reacting with silver; a reduction sensitization process using reducing substances (e.g., stannous salts, amines, hydrazine derivatives, formamidinesulfinic acid, and silane compounds); a noble metal sensitization process using noble metal compounds (e.g., complex salts of the Group VIII metals in the Periodic Table, such as Pt, Ir and Pd, etc., as well as gold complex salts); and so forth can be applied alone or in combination with each other.

The photographic emulsion used in the present invention may include various compounds for the purpose of preventing fog formation or of stabilizing photographic performance in the photographic light-sensitive material during the production, storage or photographic processing thereof. For example, those compounds known as antifoggants or stabilizers can be incorporated, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.; mercaptopyrimidines; mercaptotriazines; thioketo compounds such as oxazolinethione, etc.; azaindenes such as triazaindenes, tetraazaindenes (particularly 4-hydroxy-substituted (1,3,3a,7)tetraazaindenes), pentaazaindenes, etc.; benzenethiosulfonic acids; benzenesulfinic acids; benzenesulfonic amides; etc.

In the photographic emulsion layers or other hydrophilic colloid layers of the photographic light-sensitive material of the present invention can be incorporated various surface active agents as coating aids or for other various purposes, e.g., prevention of charging, improvement of slipping properties, acceleration of emulsification and dispersion, prevention of adhesion, and improvement of photographic characteristics (for example, development acceleration, high contrast, and sensitization), etc.

Surface active agents which can be used are nonionic surface active agents, e.g., saponin (steroid-based), alkylene oxide derivatives (e.g., polyethylene glycol, polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or polyalkylene glycol alkylamides, and silicone/polyethylene oxide adducts, ect.), glycidol derivatives (e.g., alkenyl-succinic acid polyglyceride and alkylphenol polyglyceride, etc.), fatty acid esters of polyhydric alcohols, and alkyl esters of sugar, etc.; anionic surface active agents containing an acidic group, such as a carboxy group, a sulfo group, a phospho group, a sulfuric acid ester group, and a phosphoric acid ester group, for example, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, and polyoxyethylene alkylphosphoric acid esters; amphoteric surface active agents, such as amino acids, aminoalkylsulfonic acids, aminoalkylsulfuric acid or aminoalkylphosphoric acid esters, alkylbetaines, and amine oxides; and cationic surface active agents, e.g., alkylamine salts, aliphatic or aromatic quaternary ammonium salts, heterocyclic quaternary ammonium salts (e.g., pyridinium and imidazolium), and aliphatic or heterocyclic phosphonium or sulfonium salts.

The photographic emulsion layer of the photographic light-sensitive material of the present invention may contain compounds such as polyalkylene oxide or its ether, ester, amine or like derivatives, thioether compounds, thiomorpholines, quaternary ammonium salt compounds, urethane derivatives, urea derivatives, imidazole derivatives, and 3-pyrazolidones for the purpose of increasing sensitivity or contrast, or of accelerating development.

In the photographic emulsion layer or other hydrophilic colloid layers of the photographic light-sensitive material of the present invention can be incorporated water-insoluble or sparingly soluble synthetic polymer dispersions for the purpose of improving dimensional stability, etc. Synthetic polymers which can be used include homo- or copolymers of alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefins, styrene, etc., and copolymers of the foregoing monomers and acrylic acid, methacrylic acid, $\alpha,\beta$-unsaturated dicarboxylic acid, hydroxyalkyl acrylate or methacrylate, sulfoalkyl acrylate or methacrylate, and styrenesulfonic acid, etc.

In photographic processing of layers composed of photographic emulsions in the photographic light-sensitive material of the present invention, any of known procedures and known processing solutions, e.g., those described in *Research Disclosure,* No. 176, pages 28 to 30 can be used. The processing temperature is usually chosen from between 18° C. and 50° C., although it may be lower than 18° C. or higher than 50° C.

Any fixing solutions which have compositions generally used can be used in the present invention. As fixing agents, thiosulfuric acid salts and thiocyanic acid salts, and in addition, organic sulfur compounds which are known to be effective as fixing agents can be used. These fixing solutions may contain water-soluble aluminum salts as hardeners.

Color developing solutions are usually alkaline aqueous solutions containing color developing agents. As these color developing agents, known primary aromatic amine developing agents, e.g., phenylenediamines such as 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfoamidoethylaniline, 4-amino-3-methyl-N-ethyl-N-$\beta$-methoxyethylaniline, etc., can be used.

In addition, the compounds as described in L. F. A. Mason, *Photographic Processing Chemistry,* Focal Press, pages 226 to 229 (1966), U.S. Pat. Nos. 2,193,015 and 2,592,364, Japanese Patent Application (OPI) No. 64933/73 (the term "OPI" as used herein refers to a "published unexamined Japanese patent application"), etc., may be used.

The color developing solutions can further contain pH buffering agents such as sulfites, carbonates, borates and phosphates of alkali metals, etc., developing inhibitors or antifogging agents such as bromides, iodides or organic antifogging agents, etc. In addition, if desired, the color developing solution can also contain water softeners; preservatives such as hydroxylamine, etc.; organic solvents such as benzyl alcohol, diethylene glycol, etc.; developing accelerators such as polyethylene glycol, quaternary ammonium salts, amines, etc.; dye forming couplers; competing couplers; fogging agents such as sodium borohydride, etc.; auxiliary developing agents such as 1-phenyl-3-pyrazolidone, etc.; viscosity imparting agents; polycarboxylic acid type chelating agents; antioxidizing agents; and the like.

Specific examples of such additives are described in, for example, *Research Disclosure,* Vol. 176, No. 17643, U.S. Pat. No. 4,083,723, West German Patent Application (OLS) No. 2,622,950, etc.

After color development, the photographic emulsion layer is usually subjected to a bleach processing. This bleach processing may be performed simultaneously with a fix processing, or the bleach and fix processings may be performed independently.

Bleaching agents which can be used include compounds of polyvalent metals, e.g., iron (III), cobalt (III), chromium (VI), and copper (II), peracids, quinones and nitroso compounds. For example, ferricyanides; dichromates; organic complex salts of iron (III) or cobalt (III), e.g., complex salts of aminopolycarboxylic acids (e.g., ethylenediaminetetraacetic acid, nitrilotriacetic acid, 1,3-diamino-2-propanoltetraacetic acid, etc.) or organic acids (e.g., cirtic acid, tartaric acid, malic acid, etc.); persulfates; permanganates; nitrosophenol, etc., can be used. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful in both an independent bleaching solution and a monobath bleach-fixing solution.

The photographic emulsion used in the present invention can also be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes and the complex merocyanine dyes that can be employed contain 5- or 6-membered heterocyclic nuclei such as a pyrazolin-5-one nucleus, a thiohydantoin nucleus, a 2-thioxazolidin-2,4-dione nucleus, a thiazolidine-2,4-dione nucleus, a rhodanine nucleus, a thiobarbituric acid nucleus, and the like.

These sensitizing dyes can be employed individually, and can also be employed in combination. A combination of sensitizing dyes is often used particularly for the purpose of supersensitization.

The sensitizing dyes may be present in the emulsion together with dyes which themselves do not give rise to spectral sensitizing effects but exhibit a supersensitizing effect or materials which do not substantially absorb visible light but exhibit a supersensitizing effect. For example, aminostilbene compounds substituted with a nitrogen-containing heterocyclic ring group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, and the like, can be present.

The present invention is also applicable to a multilayer multicolor photographic material containing layers sensitive to at least two different spectral wavelength ranges on a support. A multilayer natural color photographic material generally possesses at least one red-sensitive silver halide emulsion layer, at least one green-sensitive silver halide emulsion layer and at least one blue-sensitive silver halide emulsion layer, respectively, on a support. The order of these layers can be varied, if desired. Ordinarily, a cyan forming coupler is present in the red-sensitive emulsion layer, a magenta forming coupler is present in the green-sensitive emulsion layer and a yellow forming coupler is present in the blue-sensitive emulsion layer, respectively. However, if desired, a different combination can be employed.

In the photographic silver halide emulsion layer of the photographic light-sensitive material of the present invention can be incorporated, in addition to the coupler represented by the general formula (I) described above, other dye forming couplers, i.e., compounds capable of forming color upon oxidative coupling with aromatic primary amine developing agents (e.g., phenylenediamine derivatives, aminophenol derivatives, etc.) during the course of color development processing. Examples of such couplers include magenta couplers, such as 5-pyrazolone couplers, pyrazolobenzimidazole couplers, cyanoacetylcoumarone couplers and open chain acylacetonitrile couplers, etc.; yellow couplers, such as acylacetamide couplers (e.g., benzoylacetanilides, pivaloylacetanilides, etc.), etc.; and cyan couplers, such as naphthol couplers and phenol couplers, etc. It is preferable to use nondiffusible couplers containing a hydrophobic group (a so-called ballast group) within the molecule or polymeric couplers. They may be either 4-equivalent or 2-equivalent with respect to silver ions. It is also possible to use colored couplers capable of exerting color correction effects, or couplers capable of releasing development inhibitors during the course of development (so-called DIR couplers).

Further, the emulsion layer may contain non-color-forming DIR coupling compounds which release a development inhibitor, the product of which formed by a coupling reaction is colorless, other than DIR couplers.

Moreover, the photographic light-sensitive material may contain compounds which release a development inhibitor during the course of development, other than DIR couplers.

Two or more kinds of the couplers according to the present invention and the above-described couplers and the like can be incorporated together in the same layer for the purpose of satisfying the properties required of the photographic light-sensitive material, or the same compound can naturally be added to two or more layers.

The photographic light-sensitive material of the present invention may contain inorganic or organic hardeners in the photographic emulsion layer and other hydrophilic colloid layers thereof. For example, chromium salts (e.g., chromium alum, chromium acetate, etc.), aldehydes (e.g., formaldehyde, glyoxal, glutaraldehyde, etc.). N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), and mucohalogenic acids (e.g., mucochloric acid, mucophenoxychloric acid, etc.) can be used alone or in combination with each other.

In the photographic light-sensitive material of the invention, when dyes, ultraviolet light absorbing agents, and the like are incorporated in the hydrophilic colloid layers, they may be mordanted with cationic polymers, etc.

The photographic light-sensitive material of the present invention may contain therein hydroquinone derivatives, aminophenol derivatives, gallic acid derivatives, ascorbic acid derivatives, etc., as color fog preventing agents.

The hydrophilic colloid layers of the photographic light-sensitive material of the present invention can contain ultraviolet light absorbing agents. For example, benzotriazole compounds substituted with aryl groups (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese Patent Application (OPI) No. 2784/71), cinnamic acid ester compounds (e.g., those described in U.S. Pat. Nos. 3,705,805 and 3,707,375), butadiene compounds (e.g., those described in U.S. Pat. No. 4,045,229) or benzoxazole compounds (e.g., those described in U.S. Pat. No. 3,700,455) can be employed. Ultraviolet light absorbing couplers (e.g., α-naphthol type cyan dye forming couplers) and ultraviolet light absorbing polymers can also be employed. These ultraviolet light absorbing agents can also be mordanted in a specific layer(s), if desired.

The photographic light-sensitive material of the present invention may contain water-soluble dyes in the hydrophilic colloid layers thereof as filter dye or for various purposes, e.g., irradiation prevention and the like. Examples of such dyes include oxonol dyes, hemioxonol dyes, styryl dyes, merocyanine dyes, cyanine dyes, and azo dyes. In particular, oxonol dyes, hemioxonol dyes, and merocyanine dyes are useful.

In carrying out the present invention, known color fading preventing agents can be used together. Color image stabilizers can be used alone or in combination with each other. Typical known color fading preventing agents include hydroquinone derivatives, gallic acid derivatives, p-alkoxyphenols, p-oxyphenol derivatives, and bisphenols, etc.

The present invention will be explained in greater detail with reference to the following examples, but the present invention should not be construed as being limited thereto.

Unless otherwise specified, all percentages, ratios, etc., are by weight.

EXAMPLE 1

On a paper support, both surfaces of which were laminated with polyethylene, were coated a first layer (undermost layer) to a seventh layer (uppermost layer) as shown in Table 1 below in order to prepare color photographic light-sensitive materials which are designated Samples A to E.

The coating solution for the first layer was prepared in the following manner. That is, 100 g of the yellow coupler shown in Table 1 below as dissolved in a mixture of 166.7 ml of dibutyl phthalate (DBP) and 200 ml of ethyl acetate and the resulting solution was dispersed in 800 g of a 10% aqueous solution of gelatin containing 80 ml of a 10% aqueous solution of sodium dodecylbenzenesulfonate. The dispersion was mixed with 1,450 g of a blue-sensitive silver chlorobromide emulsion (containing 66.7 g of silver and having a bromide content of 80% by mol) to prepare a coating solution. Coating solutions for other layers were prepared in a similar manner. 2,4-Dichloro-6-hydroxy-s-triazine sodium salt was used as a hardener in each layer.

The following spectral sensitizing dyes were employed in the emulsion layers, respectively.

Blue-Sensitive Emulsion Layer:

Sodium salt of 3,3'-di(γ-sulfopropyl)selenacyanine: $2\times10^{-4}$ mol per mol of silver halide Green-Sensitive Emulsion Layer:

Sodium salt of 3,3'-di(γ-sulfopropyl)-5,5'-diphenyl-9-ethyloxacarbocyanine: $2.5\times10^{-4}$ mol per mol of silver halide Red-Sensitive Emulsion Layer:

Sodium salt of 3,3'-di(γ-sulfopropyl)-9-methylthiadicarbocyanine: $2.5\times10^{-4}$ mol per mol of silver halide The following dyes were employed as irradiation preventing dyes in the emulsion layers, respectively.

Green-Sensitive Emulsion Layer:

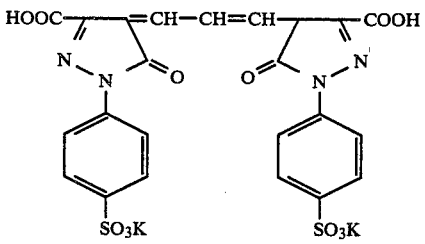

-continued

Red-Sensitive Emulsion Layer:

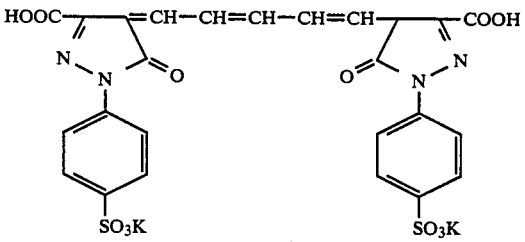

TABLE 1

| Layer | Main Composition | | Item of Gelatin ($g/m^2$) For Dilution | For Dispersion | For Photographic Emulsion |
|---|---|---|---|---|---|
| Seventh Layer (protective layer) | Gelatin | 1.62 $g/m^2$ | 1.62 | — | — |
| Sixth Layer | Gelatin | 1.06 $g/m^2$ | 0.53 | 0.53 | — |
| | Ultraviolet Light Absorbing Agent (*1) | 0.35 $g/m^2$ | | | |
| | Ultraviolet Light Absorbing Agent Solvent (*2) | 0.12 $g/m^2$ | | | |
| Fifth Layer | Silver Chlorobromide Emulsion (silver bromide: 50 mol %) | 0.25 $g/m^2$ (as silver) | | | |
| | Gelatin | 1.26 $g/m^2$ | 0.43 | 0.53 | 0.30 |
| | Cyan Coupler (*3) | 0.50 $g/m^2$ | | | |
| | Coupler Solvent (*2) | 0.25 $g/m^2$ | | | |
| Fourth Layer | Gelatin | 1.60 $g/m^2$ | 0.80 | 0.80 | — |
| | Ultraviolet Light Absorbing Agent (*1) | 0.70 $g/m^2$ | | | |
| | Color Mixing Preventing Agent (*4) | 0.20 $g/m^2$ | | | |
| | Solvent (*2) | 0.30 $g/m^2$ | | | |
| Third Layer | Silver Chlorobromide Emulsion (silver bromide: 70 mol %) | 0.15 $g/m^2$ (as silver) | | | |
| | Gelatin | 1.40 $g/m^2$ | 0.67 | 0.30 | 0.43 |
| | Magenta Coupler (*5) | 0.45 $g/m^2$ | | | |
| | Coupler Solvent (*6) | 0.40 $g/m^2$ | | | |
| Second Layer | Gelatin | 1.10 $g/m^2$ | 0.97 | 0.13 | — |
| | Color Mixing Preventing Agent (*4) | 0.20 $g/m^2$ | | | |
| | Solvent (*2) | 0.10 $g/m^2$ | | | |
| First Layer | Silver Chlorobromide Emulsion (silver bromide: 80 mol %) | 0.35 $g/m^2$ (as silver) | | | |
| | Gelatin | 1.54 $g/m^2$ | 0.70 | 0.47 | 0.37 |
| | Yellow Coupler (*7) | 0.50 $g/m^2$ | | | |

TABLE 1-continued

| Layer | Main Composition | Item of Gelatin ($g/m^2$) For Dilution | For Dispersion | For Photographic Emulsion |
|---|---|---|---|---|
| | Coupler Solvent (*2) 0.50 $g/m^2$ | | | |

(*1)

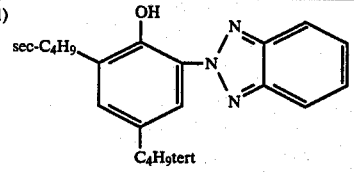

(*2)

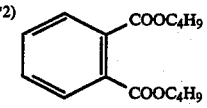

(*3)

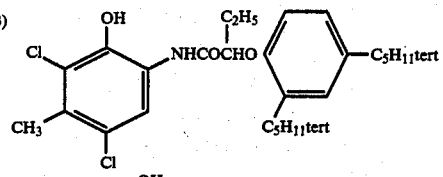

(*4)

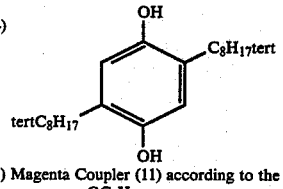

(*5) Magenta Coupler (11) according to the present invention (*6)

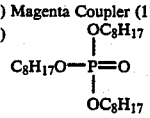

(*7)

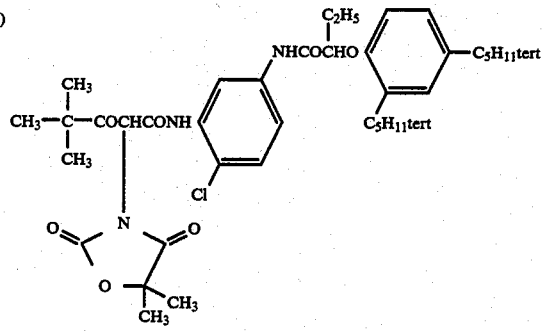

The gelatin used in all the layers of Photographic Material A was a lime-processed gelatin having a calcium content of 2,500 ppm.

Photographic Material B was prepared in the same manner as described for Photographic Material A except using demineralized gelatin having a calcium content of 40 ppm as the gelatin for dilution in each layer. Also, Photographic Material C was prepared in the same manner as described for Photographic Material A except using demineralized gelatin having a calcium content of 40 ppm as the gelatin for dilution and as the gelatin for dispersion in each layer. Further, Photographic Material D was prepared in the same manner as described for Photographic Material A except using demineralized gelatin having a calcium content of 40 ppm as gelatin in all the layers. Moreover, Photographic Material E was prepared in the same manner as described for A except using 0.4 $g/m^2$ of the so-called 4-equivalent magenta coupler, i.e., 1-(2,4,6-trichlorophenyl)-3-(2-chloro-5-tetradecanamido)anilino-2-pyrazolin-5-one, which is outside of the scope of the present invention, in place of Magenta Coupler (11) in the third layer and changing the coating amount of silver to 0.35 $g/m^2$.

These samples were imagewise exposed to light and subjected to continuous processing using a Fuji Color Roll Processor FPRP 102 (manufactured by Fuji Photo Film Co., Ltd.).

The processing steps were as follows.

| Processing Step | Temperature (°C.) | Time |
|---|---|---|
| 1. Color Development | 33 | 3 min 30 sec |
| 2. Bleach-Fixing | 33 | 1 min 30 sec |
| 3. Washing with Water | 24 to 34 | 3 min |

Each processing time included time for each processing bath and crossover time to the following bath.

The composition of each processing solution was as follows.

| Color Developing Solution A | Tank Solution | Replenisher |
|---|---|---|
| Distilled Water | 800 ml | 800 ml |
| Triethanolamine | 11.0 ml | 11.0 ml |
| Diethylene Glycol | 0.2 ml | 0.2 ml |
| Benzyl Alcohol | 14.0 ml | 18.0 ml |
| Lithium Chloride | 2.1 g | 2.1 g |
| Potassium Bromide | 0.6 g | — |
| Hydroxylamine Sulfate | 3.0 g | 4.0 g |
| Potassium Sulfite | 1.8 g | 2.4 g |
| Anti Ca No. 5 (manufactured by Eastman Kodak Co.) | 0.80 ml | 0.80 ml |
| 4-Amino-3-methyl-N—ethyl-N—[β-(methanesulfonamido)-ethyl]-p-phenylenediamine Sulfate | 4.25 g | 6.50 g |
| Potassium Carbonate | 28.0 g | 28.0 g |
| Distilled Water to make | 1,000 ml | 1,000 ml |
| pH at 25° C. | 10.10 | 10.30 |

Further, 0.82 g of calcium nitrate was added to each of the tank solution and replenisher of Color Developing Solution A to prepare Color Developing Solution B.

| Bleach-Fixing Solution | Tank Solution | Replenisher |
|---|---|---|
| Water | 400 ml | 400 ml |
| Ammonium Thiosulfate (70% solution) | 150 ml | 300 ml |
| Sodium Sulfite | 18 g | 36 g |
| Ammonium Ethylenediaminetetra-acetato Iron (III) | 55 g | 110 g |
| Disodium Ethylenediaminetetra-acetate | 5 | 10 g |
| Water to make | 1,000 ml | 1,000 ml |
| ph at 25° C. | 6.70 | 6.50 |

The conditions of processing were as follows.

| Processing | Amount of Replenish per $m^2$ | Tank Capacity of Automatic Processor |
|---|---|---|
| Color Development | 330 ml | 96 l |
| Bleach-Fixing | 60 ml | 50 l |
| Washing with Water | 10 l | 26 l × 3 |

Using the above-described processing solutions and processing conditions each sample imagewise exposed to light was continuously processed. An amount of the photographic materials processed was 1,000 $m^2$ per day and the processing was carried out for 10 days.

In order to determine changes in the photographic properties, each sample wedge-exposed was processed at the first day and the last day of the processing.

The green light reflective densities of the magenta dye images thus obtained were measured and the maximum densities ($D_{max}$) and relative sensitivities were determined. The results are shown in Table 2 below.

TABLE 2

| Sample | Calcium Content (mg/$m^2$) | Color Developing Solution A: Start of Processing Dmax | Color Developing Solution A: Start of Processing Relative Sensitivity | Color Developing Solution A: End of Processing Dmax | Color Developing Solution A: End of Processing Relative Sensitivity | Color Developing Solution B: Start of Processing Dmax | Color Developing Solution B: Start of Processing Relative Sensitivity | Color Developing Solution B: End of Processing Dmax | Color Developing Solution B: End of Processing Relative Sensitivity |
|---|---|---|---|---|---|---|---|---|---|
| A (Comparison) | 24.0 | 2.46 | 90 | 2.15 | 76 | 2.18 | 80 | 2.03 | 64 |
| B (Present Invention) | 9.88 | 2.62 | 99 | 2.56 | 93 | 2.56 | 92 | 2.21 | 84 |
| C (Present Invention) | 3.09 | 2.61 | 100 | 2.62 | 99 | 2.61 | 100 | 2.59 | 96 |
| D (Present Invention) | 0.38 | 2.62 | 100 | 2.61 | 100 | 2.62 | 100 | 2.60 | 98 |
| E (Comparison) | 24.0 | 2.25 | 82 | 2.23 | 78 | 2.24 | 78 | 2.22 | 76 |

It is apparent from the results shown in Table 2 above that with Sample A having a high content of calcium the decreases in $D_{max}$ and sensitivity are observed under all of the processing conditions. This tendency is strong at the end of the continuous processing and particularly remarkable when using Color Developing Solution B. In Sample B, a sufficient $D_{max}$ and sensitivity which are good for practical use are obtained with Color Developing Solution A. However, the tendency to decrease in the photographic properties is observed at the end of the continuous processing using Color Developing Solution A and in case of using Color Developing Solution B. With Sample C, although sufficient properties can be obtained with Color Developing Solution A, a little degradation of the photographic properties is observed at the end of the continuous processing using Color Developing Solution B. On the other hand, in Sample D, photographic properties sufficient for practical use can be obtained under any of the processing conditions and the effects of the present invention are remarkably obtained. Further, in Sample E using the so-called 4-equivalent type magenta coupler, the change in the photographic properties depending on the variation of processing conditions is small, but the color density and sensitivity are low in spite of using the large coating amount of silver.

Almost the same results were obtained by employing Couplers (5), (10), (16) or (20), etc., in place of the magenta coupler in the third layer of Samples A to D, respectively.

EXAMPLE 2

Multilayer photographic light-sensitive materials for color paper as shown in Table 3 below which were designated Samples F and G were prepared in the same manner as described in Example 1 except for the following points. That is, the calcium content was 1.2 mg/m$^2$ in Samples F and G. Sample F was the photographic light-sensitive material according to the present invention containing the magenta coupler represented by the general formula (I) in the third layer, and Sample G is a comparative photographic light-sensitive material containing the so-called 4-equivalent type magenta coupler in the third layer.

TABLE 3

| Layer | Main Composition | Sample F | Sample G |
|---|---|---|---|
| Seventh Layer (protective layer) | Gelatin | 1.5 g/m$^2$ | 1.5 g/m$^2$ |
| Sixth Layer (ultraviolet light absorbing layer) | Gelatin | 1.5 g/m$^2$ | 1.5 g/m$^2$ |
| | Ultraviolet Light Absorbing Agent (*1) | 0.45 g/m$^2$ | 0.45 g/m$^2$ |
| | Ultraviolet Light Absorbing Agent Solvent (*2) | 0.2 g/m$^2$ | 0.2 g/m$^2$ |
| Fifth Layer (red-sensitive layer) | Silver Chlorobromide Emulsion (silver bromide: 50 mol %) | 0.3 g/m$^2$ (as silver) | 0.3 g/m$^2$ (as silver) |
| | Gelatin | 1.2 g/m$^2$ | 1.2 g/m$^2$ |
| | Cyan Coupler (*3) | 0.4 g/m$^2$ | 0.4 g/m$^2$ |
| | Cyan Coupler Solvent (*2) | 0.24 g/m$^2$ | 0.24 g/m$^2$ |
| Fourth Layer (ultraviolet light absorbing layer) | Gelatin | 2.0 g/m$^2$ | 2.0 g/m$^2$ |
| | Ultraviolet Light Absorbing Agent (*1) | 0.06 g/m$^2$ | 0.06 g/m$^2$ |
| | Ultraviolet Light Absorbing Agent Solvent (*2) | 0.06 g/m$^2$ | 0.06 g/m$^2$ |
| Third Layer (green-sensitive layer) | Silver Chlorobromide Emulsion (silver bromide: 70 mol %) | 0.2 g/m$^2$ (as silver) | 0.45 g/m$^2$ (as silver) |
| | Gelatin | 1.4 g/m$^2$ | 1.4 g/m$^2$ |
| | Magenta Coupler | 0.35 g/m$^2$ (*4) | 0.3 g/m$^2$ (*5) |
| | Solvent (*6) | 0.2 g/m$^2$ | 0.44 g/m$^2$ |
| | Solvent (*7) | 0.2 g/m$^2$ | — |
| | Color Mixing Preventing Agent (*8) | 0.05 g/m$^2$ | 0.05 g/m$^2$ |
| | Color Mixing Preventing Agent (*9) | 0.1 g/m$^2$ | 0.1 g/m$^2$ |
| Second Layer (color mixing preventing layer) | Gelatin | 1.5 g/m$^2$ | 1.5 g/m$^2$ |
| First Layer (blue-sensitive layer) | Silver Chlorobromide Emulsion (silver bromide: 80 mol %) | 0.4 g/m$^2$ (as silver) | 0.4 g/m$^2$ (as silver) |
| | Gelatin | 1.5 g/m$^2$ | 1.5 g/m$^2$ |
| | Yellow Coupler (*10) | 0.6 g/m$^2$ | 0.6 g/m$^2$ |
| | Solvent (*2) | 0.6 g/m$^2$ | 0.6 g/m$^2$ |
| | Color Mixing Preventing Agent (*11) | 0.1 g/m$^2$ | 0.1 g/m$^2$ |

(*1)

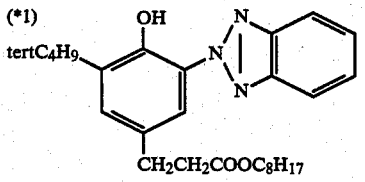

(*2)

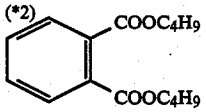

TABLE 3-continued

| Layer | Main Composition | Sample F | Sample G |
|---|---|---|---|

(*3)

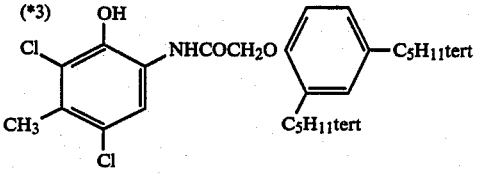

(*4) Magenta Coupler (11) according to the present invention (*5)

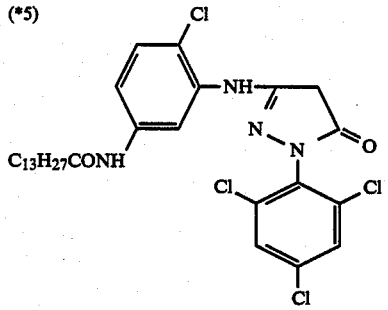

(*6)

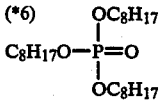

(*7)

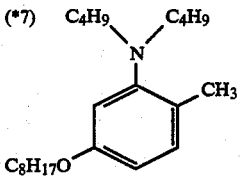

(*8)

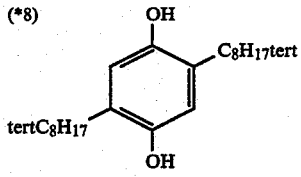

(*9)

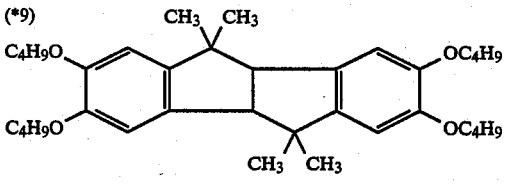

(*10)

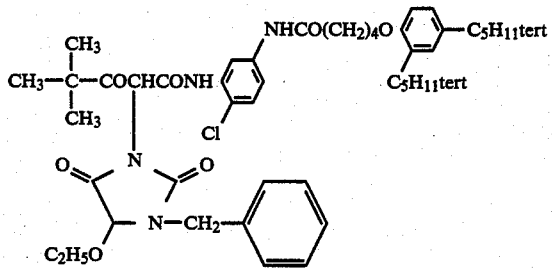

TABLE 3-continued

| Layer | Main Composition | Sample F | Sample G |
|---|---|---|---|
| (*11) | 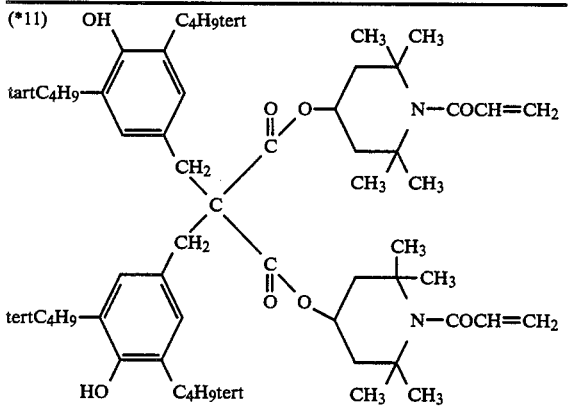 | | |

Samples F and G were subjected to the same development processing as described in Example 1 and the $D_{max}$ and relative sensitivity of the magenta color image thus obtained were measured. The results are shown in Table 4 below.

TABLE 4

| | Color Developing Solution A | | | | Color Developing Solution B | | | |
|---|---|---|---|---|---|---|---|---|
| | Start of Processing | | End of Processing | | Start of Processing | | End of Processing | |
| Sample | Dmax | Relative Sensitivity | Dmax | Relative Sensitivity | Dmax | Relative Sensitivity | Dmax | Relative Sensitivity |
| F (Present Invention) | 2.65 | 99 | 2.64 | 100 | 2.66 | 100 | 2.65 | 98 |
| G (Comparison) | 2.55 | 83 | 2.52 | 80 | 2.53 | 81 | 2.51 | 78 |

It is apparent from the results shown in Table 4 above that Sample F according to the present invention exhibits excellent photographic properties under any processing condition. On the contrary, in Sample G for comparison the decreases in the $D_{max}$ and sensitivity are observed under each processing condition, in spite of using the large coating amount of silver.

Furthermore, the samples were subjected to the development processing using Color Developing Solution A as described above and then a fading test for 5 days using a xenon fading tester (200,000 lux). The results thus obtained are shown in Table 5 below.

TABLE 5

| | Density of Magenta Color Image after Xenon Irradiation | |
|---|---|---|
| Sample | Area Having Initial Density of 1.0 | Area Having Initial Density of 2.0 |
| F (Present Invention) | 0.95 | 1.82 |
| G (Comparison) | 0.71 | 1.49 |

It is apparent from the results shown in Table 5 above that the fading of magenta color image due to the xenon irradiation is extremely small in Sample F according to the present invention and Sample F has an excellent light fastness in comparison with Sample G for comparison.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having coated thereon at least one silver halide emulsion layer, the color photographic light-sensitive material having a photographic layer containing at least 2-equivalent 5-pyrazolone type magenta coupler represented by the general formula (I) described below and an amount of a calcium atom contained in the color photographic light-sensitive material being up to 10 mg/m$^2$:

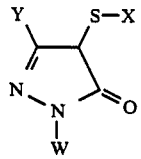

(I)

wherein W represents an aryl group; X represents an aliphatic group, an aryl group or a heterocyclic group; and Y represents an acylamino group, a ureido group or an anilino group.

2. A silver halide color photographic light-sensitive material as claimed in claim 1, wherein W represents a phenyl or naphthyl group substituted with at least one of a halogen atom, an alkyl group, an alkoxy group, an alkoxycarbonyl group and a cyano group.

3. A silver halide color photographic light-sensitive material as claimed in claim 1, wherein the aliphatic group represented by X has 1 to 42 carbon atoms.

4. A silver halide color photographic light-sensitive material as claimed in claim 3, wherein the aliphatic group represented by X is a straight chain or branched chain alkyl group, an alkenyl group, a cycloalkyl group, an aralkyl group or an alkynyl group.

5. A silver halide color photographic light-sensitive material as claimed in claim 4, wherein the aliphatic group represented by X is substituted with one or more substituents selected from the group consisting of a halogen atom, a hydroxy group, a mercapto group, a cyano group, a nitro group, a carboxy group, an aryl group, an alkoxy group, an aryloxy group, a heterocyclic oxy group, an acyloxy group, an alkoxycarbonyloxy group, an aryloxycarbonyloxy group, a silyloxy group, a carbamoyloxy group, a phosphoric acid oxy group, an acylamino group, a sulfonamido group, an alkoxycarbonylamino group, an aryloxycarbonylamino group, a diacylamino group, a carbamoylamino group, a sulfamoylamino group, an aromatic heterocyclic group, a non-aromatic heterocyclic group, an imido group, a monooxo nitrogen containing heterocyclic group, an acyl group, an alkoxycarbonyl group, an aryloxycarbonyl group, a carbamoyl group, a sulfamoyl group, a silyl group, an alkylthio group, an arylthio group, a heterocyclic thio group, a sulfonyl group, a sulfinyl group and an anilino group.

6. A silver halide color photographic light-sensitive material as claimed in claim 1, wherein the aryl group represented by X has from 6 to 46 carbon atoms.

7. A silver halide color photographic light-sensitive material as claimed in claim 6, wherein the aryl group represented by X is a phenyl group or a naphthyl group.

8. A silver halide color photographic light-sensitive material as claimed in claim 7, wherein the aryl group represented by X is substituted with one or more substituents selected from the group consisting of a halogen atom, a hydroxy group, a mercapto group, a cyano group, a nitro group, a carboxy group, an aryl group, an alkoxy group, an aryloxy group, a heterocyclic oxy group, an acyloxy group, an alkoxycarbonyloxy group, an aryloxycarbonyloxy group, a silyloxy group, a carbamoyloxy group, a phosphoric acid oxy group, an acylamino group, a sulfonamido group, an alkoxycarbonylamino group, an aryloxycarbonylamino group, a diacylamino group, a carbamoylamino group, a sulfamoylamino group, an aromatic heterocyclic group, a non-aromatic heterocyclic group, an imido group, a monooxo nitrogen containing heterocyclic group, an acyl group, an alkoxycarbonyl group, an aryloxycarbonyl group, a carbamoyl group, a sulfamoyl group, a silyl group, an alkylthio group, an arylthio group, a heterocyclic thio group, a sulfonyl group, a sulfinyl group, an anilino group and an alkyl group.

9. A silver halide color photographic light-sensitive material as claimed in claim 1, wherein the heterocyclic group represented by X is a 5-membered or 6-membered heterocyclic group containing at least one of a nitrogen atom, an oxygen atom and a sulfur atom.

10. A silver halide color photographic light-sensitive material as claimed in claim 9, wherein the 5- or 6-membered heterocyclic group is further condensed with a benzene ring.

11. A silver halide color photographic light-sensitive material as claimed in claim 9, wherein the heterocyclic group represented by X is represented by the following formulae:

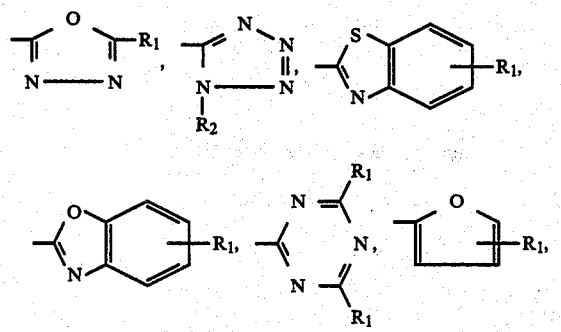

-continued

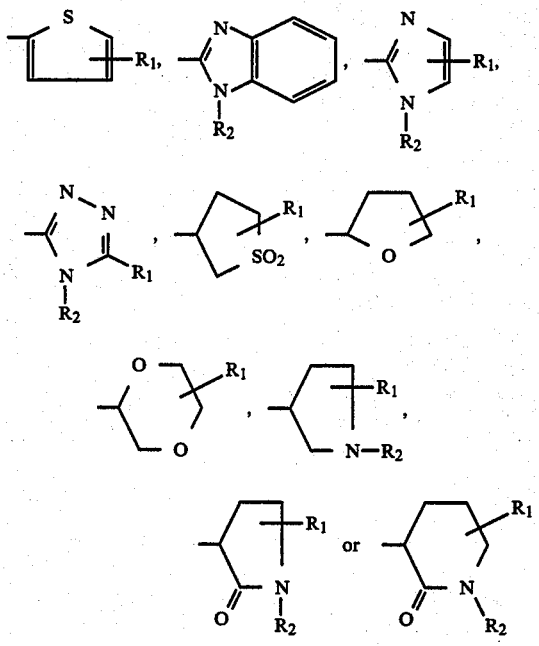

wherein $R_1$ represents a hydrogen atom, a halogen atom, a hydroxy group, a mercapto group, a cyano group, a nitro group, a carboxy group, an aryl group, an alkoxy group, an aryloxy group, a heterocyclic oxy group, an acyloxy group, an alkoxycarbonyloxy group, an aryloxycarbonyloxy group, a silyloxy group, a carbamoyloxy group, a phosphoric acid oxy group, an acylamino group, a sulfonamido group, an alkoxycarbonylamino group, an aryloxycarbonylamino group, a diacylamino group, a carbamoylamino group, a sulfamoylamino group, an aromatic heterocyclic group, a non-aromatic heterocyclic group, an imido group, a monooxo nitrogen containing heterocyclic group, an acyl group, an alkoxycarbonyl group, an aryloxycarbonyl group, a carbamoyl group, a sulfamoyl group, a silyl group, an alkylthio group, an arylthio group, a heterocyclic thio group, a sulfonyl group, a sulfinyl group, an anilino group or an alkyl group; and $R_2$ represents a hydrogen atom, an alkyl group, an aryl group, an acyl group, an alkylsulfonyl group or an arylsulfonyl group.

12. a silver halide color photographic light-sensitive material as claimed in claim 1, wherein Y represents an alkanamido group, a benzamido group, an alkylureido group, a phenylureido group, or a phenylamino group, where each alkyl moiety in the groups has from 1 to 42 carbon atoms and each phenyl moiety in the groups has from 6 to 46 carbon atoms.

13. A silver halide color photographic light-sensitive material as claimed in claim 11, wherein the alkyl moiety is substituted with one or more substituents selected from a halogen atom, a hydroxy group, a mercapto group, a cyano group, a nitro group, a carboxy group, an aryl group, an alkoxy group, an aryloxy group, a heterocyclic oxy group, an acyloxy group, an alkoxycarbonyloxy group, an aryloxycarbonyloxy group, a silyloxy group, a carbamoyloxy group, a phosphoric acid oxy group, an acylamino group, a sulfonamido group, an alkoxycarbonylamino group, an aryloxycarbonylamino group, a diacylamino group, a carbamoylamino group, a sulfamoylamino group, an aromatic heterocyclic group, a non-aromatic heterocyclic group, an imido group, a monooxo nitrogen containing heterocyclic group, an acyl group, an alkoxycarbonyl group, an aryloxycarbonyl group, a carbamoyl group, a sulfamoyl group, a silyl group, an alkylthio group, an arylthio group, a heterocyclic thio group, a sulfonyl group, a sulfinyl group and an anilino group; and the phenyl moiety is substituted with one or more substituents selected from an alkyl group and the substituents for the alkyl moiety described above.

14. A silver halide color photographic light-sensitive material as claimed in claim 1, wherein the 2-equivalent 5-pyrazolone type magenta coupler is represented by the following general formula (II) or (III):

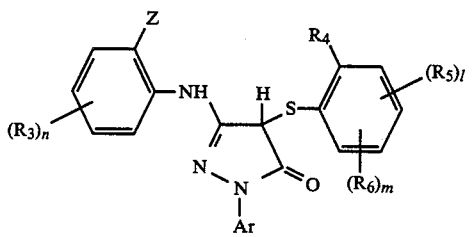

(II)

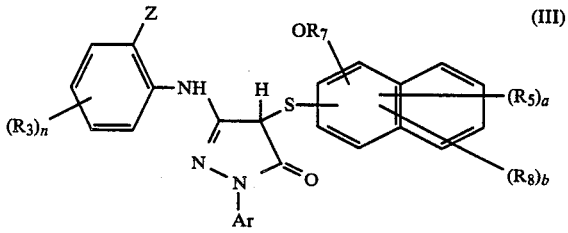

(III)

wherein Ar represents a phenyl group substituted with at least one of a halogen atom, an alkyl group, an alkoxy group, an alkoxycarbonyl group or a cyano group; Z represents a halogen atom or an alkoxy group; $R_3$ represents a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, a ureido group, an acyl group, a nitro group or a carboxy group; $R_4$ represents a halogen atom, a hydroxy group, an amino group, an aliphatic group, an alkoxy group, an aryloxy group or an aryl group; $R_5$ represents a hydrogen atom, an amino group, an acylamino group, a ureido group, an alkoxycarbonylamino group, an imino group, a sulfonamido group, a sulfamoylamino group, a nitro group, an alkoxycarbonyl group, a carbamoyl group, an acyl group, a cyano group or an alkylthio group; $R_6$ represents a hydrogen atom, a halogen atom, a hydroxy group, an aliphatic group, an alkoxy group or an aryl group; at least one of $R_4$ and $R_6$ represents an alkoxy group; n represents an integer of from 1 to 4; m represents an integer of from 1 to 3; l represents an integer of from 1 to 3; $R_7$ represents an aliphatic group or an aryl group; $R_8$ represents a hydrogen atom, a halogen atom, an aliphatic group, an alkoxy group, an aryloxy group or an aryl group; a represents an integer of from 1 to 5; and b represents an integer of from 1 to 5.

15. A silver halide color photographic light-sensitive material as claimed in claim 14, wherein the alkyl moiety included in the alkyl group, the alkoxy group or the alkoxycarbonyl group as the substituent for the phenyl group represented by Ar has from 1 to 22 carbon atoms.

16. A silver halide color photographic light-sensitive material as claimed in claim 14, wherein the alkoxy group represented by Z is an alkoxy group having from 1 to 22 carbon atoms.

17. A silver halide color photographic light-sensitive material as claimed in claim 14, wherein the alkyl moiety included in the substituent represented by $R_3$ has from 1 to 42 carbon atoms.

18. A silver halide color photographic light-sensitive material as claimed in claim 14, wherein the aryl moiety included in the substituent represented by $R_3$ has from 6 to 46 carbon atoms.

19. A silver halide color photographic light-sensitive material as claimed in claim 14, wherein the amino group represented by $R_4$ is an unsubstituted amino group, an N-alkylamino group, an N,N-dialkylamino group, an N-anilino group, an N-alkyl-N-arylamino group or a heterocyclic amino group.

20. A silver halide color photographic light-sensitive material as claimed in claim 14, wherein the aliphatic group represented by $R_4$ is a straight chain or branched chain alkyl group, an aralkyl group, an alkenyl group, a cycloalkyl group or a cycloalkenyl group.

21. A silver halide color photographic light-sensitive material as claimed in claim 14, wherein the aryl group represented by $R_4$ is an unsubstituted or substituted phenyl group having from 6 to 38 carbon atoms or an $\alpha$- or $\beta$-naphthyl group.

22. A silver halide color photographic light-sensitive material as claimed in claim 14, wherein the amino group represented by $R_5$ is an unsubstituted amino group, an N-alkylamino group, an N,N-dialkylamino group, an N-anilino group, an N-alkyl-N-arylamino group or a heterocyclic amino group.

23. A silver halide color photographic light-sensitive material as claimed in claim 14, wherein the aliphatic group represented by $R_6$ is a straight chain or branched chain alkyl group, an aralkyl group, an alkenyl group, a cycloalkyl group or a cycloalkenyl group.

24. A silver halide color photographic light-sensitive material as claimed in claim 14, wherein the aryl group represented by $R_6$ is an unsubstituted or substituted phenyl group having from 6 to 38 carbon atoms or an $\alpha$- or $\beta$-naphthyl group.

25. A silver halide color photographic light-sensitive material as claimed in claim 14, wherein the aliphatic group represented by $R_7$ is a straight chain or branched chain alkyl group, an aralkyl group, an alkenyl group, a cycloalkyl group or a cycloalkenyl group.

26. A silver halide color photographic light-sensitive material as claimed in claim 14, wherein the aryl group represented by $R_7$ is an unsubstituted or substituted phenyl group having from 6 to 38 carbon atoms or an α- or β-naphthyl group.

27. A silver halide color photographic light-sensitive material as claimed in claim 14, wherein the aliphatic group represented by $R_8$ is a straight chain or branched chain alkyl group, an aralkyl group, an alkenyl group, a cycloalkyl group or a cycloalkenyl group.

28. A silver halide color photographic light-sensitive material as claimed in claim 14, wherein the aryl group represented by $R_8$ is an unsubstituted or substituted phenyl group having from 6 to 38 carbon atoms or an α- or β-naphthyl group.

29. A silver halide color photographic light-sensitive material as claimed in claim 1, wherein the 2-equivalent 5-pyrazolone type magenta coupler is present in an amount ranging from $10^{-3}$ mol to 0.5 mol per mol of silver.

30. A silver halide color photographic light-sensitive material as claimed in claim 1, wherein an amount of the calcium atom is 5 mg/m$^2$ or less.

31. A silver halide color photographic light-sensitive material as claimed in claim 1, wherein an amount of the calcium atom is 2 mg/m$^2$ or less.

32. A silver halide color photographic light-sensitive material as claimed in claim 1, wherein the 2-equivalent 5-pyrazolone type magenta coupler represented by the general formula (I) is present in a silver halide emulsion layer.

33. A silver halide color photographic light-sensitive material as claimed in claim 32, wherein the silver halide emulsion layer is a green-sensitive silver halide emulsion layer.

34. A silver halide color photographic light-sensitive material as claimed in claim 33, wherein the photographic material further comprises a blue-sensitive silver halide emulsion layer containing a yellow color forming coupler and a red-sensitive silver halide emulsion layer containing a cyan color forming coupler.

35. A silver halide color photographic light-sensitive material as claimed in claim 34, wherein the photographic material is a color printing paper.

36. A silver halide color photographic light-sensitive material as claimed in claim 1, wherein the photographic material contains gelatin.

37. A silver halide color photographic light-sensitive material as claimed in claim 36, wherein at least a part of the gelatin contained in the photographic material is demineralized gelatin.

38. A silver halide color photographic light-sensitive material as claimed in claim 37, wherein all of the gelatin contained in the photographic material is demineralized gelatin.

* * * * *